US005623911A

United States Patent [19]

Kiyomiya et al.

[11] Patent Number: 5,623,911

[45] Date of Patent: Apr. 29, 1997

[54] FUEL VAPOR TREATING APPARATUS

[75] Inventors: Shinsuke Kiyomiya, Seto; Koji Okawa, Toyota; Mitsuru Takada, Aichi-ken; Takashi Ishikawa, Okazaki, all of Japan

[73] Assignee: Toyota Jidosha Kabushiki Kaisha, Toyota, Japan

[21] Appl. No.: 503,111

[22] Filed: Jul. 17, 1995

[30] Foreign Application Priority Data

Jul. 29, 1994 [JP] Japan ..... 6-179086
Feb. 3, 1995 [JP] Japan ..... 7-017288

[51] Int. Cl.[6] ..... F02M 37/04

[52] U.S. Cl. ..... 123/520; 123/516

[58] Field of Search ..... 123/518, 519, 123/520, 521, 516, 198 D

[56] References Cited

U.S. PATENT DOCUMENTS

| | | | |
|---|---|---|---|
| 4,496,379 | 1/1985 | Kozawa . | |
| 4,815,436 | 3/1989 | Sasaki | 123/520 |
| 4,951,643 | 8/1990 | Sato et al. . | |
| 5,123,459 | 6/1992 | Toshihiro | 123/520 |
| 5,170,765 | 12/1992 | Hoshino et al. . | |
| 5,173,095 | 12/1992 | Yasukawa et al. . | |
| 5,295,472 | 3/1994 | Otsaka | 123/520 |
| 5,337,721 | 8/1994 | Kasuya et al. . | |
| 5,355,861 | 10/1994 | Arai . | |
| 5,398,660 | 3/1995 | Koyama et al. . | |
| 5,408,976 | 4/1995 | Reddy . | |
| 5,437,257 | 8/1995 | Giacomazzi | 123/520 |
| 5,460,136 | 10/1995 | Yamazaki et al. . | |
| 5,462,100 | 10/1995 | Covert et al. . | |
| 5,474,048 | 12/1995 | Yamazaki et al. . | |
| 5,477,836 | 12/1995 | Hyodo | 123/520 |

FOREIGN PATENT DOCUMENTS

| | | | |
|---|---|---|---|
| 0130254 | 5/1990 | Japan | 123/519 |
| 4347357A | 12/1992 | Japan . | |
| 533734A | 2/1993 | Japan . | |
| 526118A | 2/1993 | Japan . | |

*Primary Examiner*—Carl S. Miller
*Attorney, Agent, or Firm*—Kenyon & Kenyon

[57] ABSTRACT

Disclosed is a fuel vapor treating apparatus, in which fuel vapor evaporated in a fuel tank is not released directly into the atmosphere but is collected and treated. This apparatus is provided with a canister for collecting fuel vapor and a purge line for purging the fuel vapor collected in the canister to an intake passage of an engine. The canister has a first control valve for controlling introduction of fuel vapor thereto. The canister also has a second control valve for controlling the introduction of outside air and the exhaust of gas therefrom. The first control valve communicates with a vapor line extending from the fuel tank and is opened whenever the internal pressure of the fuel tank exceeds a predetermined level to introduce fuel vapor from the fuel tank into the canister. The second control valve is designed to communicate with the atmosphere and is opened whenever fuel is purged through the purge line to the intake passage to introduce outside air into the canister. The second control valve is opened whenever the internal pressure of the canister exceeds a predetermined level to exhaust fuel-free gas left after collection of the fuel. Both the first control valve and the second control valve are diaphragm check valves. The control valves are designed to be readily detached from the canister.

10 Claims, 12 Drawing Sheets

FUEL VAPOR TREATING APPARATUS

BACKGROUND OF THE INVENTION

1. Field of the Invention

The present invention relates generally to a fuel vapor treating apparatus, in which the fuel vapor formed in a fuel tank is not to be released into the atmosphere but is to be collected and treated. More particularly, the present invention relates to a fuel vapor treating apparatus provided with a canister for collecting the fuel vapor and a device for suitably purging the fuel collected in the canister to an intake passage of an engine.

2. Description of the Related Art

There is a known fuel vapor treating apparatus to be mounted on a vehicle in which the fuel vapor evaporated in a fuel tank is not released into the atmosphere but is collected. Such apparatus is, for example, provided with a canister 183 in which the fuel vapor evaporated in a fuel tank 181 is collected through a vapor line 182, as shown in FIG. 14. The canister 183 contains an adsorbent 184 such as an activated carbon or the like. A purge line 185 extends from the canister 183 and is connected to an air intake passage 187 of an engine 186. In the canister 183, the fuel vapor introduced through the vapor line 182 is adsorbed in the adsorbent 184, and only the residual gas containing no fuel is exhausted through a vent 188 to the outside of the system. Further, during operation of the engine 186, the fuel collected in the canister 183 is, as necessary, purged through the purge line 185 to the air intake passage 187.

Japanese Unexamined Patent Publication No. Hei 4-347357 discloses another system. As shown in FIG. 15, in this apparatus, a vapor line 182 extending from a fuel tank is connected to a canister 190 via a first control valve 189 which is a ball check valve. This control valve 189 opens when the internal pressure of the tank exceeds a predetermined level due to evaporation of fuel in the tank. The opening of the first control valve 189 allows the fuel vapor contained in the tank to flow into the canister 190 through the vapor line 182.

A second control valve 193 and a third control valve 194 controlling an inlet 191 and an outlet 192, respectively, of the canister 190 are selectively opened depending on the balance between the internal pressure of the canister 190 and the atmospheric pressure. Both the control valve 193 and 194 are ball check valves. The second control valve 193 is let open so as to introduce outside air into the canister 190 when the fuel adsorbed in the canister 190 is to be purged to the air intake passage 187. Meanwhile, the third control valve 194 is let open to exhaust the gas containing no fuel from the canister 190 to the outside of the system whenever the internal pressure of the canister 190 exceeds a predetermined level.

Leakage of fuel vapor to the atmosphere, particularly that which leaks through the ports of tanks when fuel is charged to the tanks, wastes fuel. Thus, there are disclosed systems with respect to the above-described canister, which are designed to treat large amounts of fuel vapor formed during refueling. For example, U.S. Pat. No. 4,714,172 discloses such system which is provided, in addition to the vapor line, with a special breather line between the fuel tank and the canister. Fuel vapor, formed in large amounts in the tank during refueling, can be smoothly introduced to the canister through the breather line.

Only the fuel component of the fuel vapor introduced to the canister during refueling is collected in the canister, and the gas containing no fuel component is exhausted through a control valve disposed in an outlet opening to the atmosphere.

The amount of the fuel vapor flowing into the canister from the tank during refueling is great. Accordingly, if the control valve disposed in the breather line is a simple ball check valve, a great resistance is generated when the fuel vapor passes through the valve. This resistance inhibits smooth flow of the fuel vapor from the tank to the canister and increases the internal pressure of the tank. This increase of the internal pressure inhibits smooth refueling.

On the other hand, in order to treat such a large amount of fuel vapor with the adsorbent contained in the canister, the adsorbent must be constantly maintained to have sufficient fuel adsorbing capacity. Accordingly, when the fuel is to be purged from the canister, the fuel must be quickly released from the adsorbent by introducing a large amount of outside air into the canister. For this purpose, a ball check valve can conceivably be used as the control valve for controlling introduction of the outside air. However, if such is the case, it is difficult to introduce a large amount of outside air because the diameter of the ball check valve itself is small.

It is conceivable to employ a diaphragm check valve as the control valve in place of the ball check valve. The diaphragm check valve has a valve diameter larger than that of the ball check valve and allows a large amount of gas to pass through it. However, the diaphragm check valve, if employed as the control valve of the canister, causes some problems. One of the problems occurs when a purge control valve for controlling the purge amount is provided in the purge line, and the control valve is subjected to duty control. Here, in order to suitably control the purge amount from the canister, the actuation of the purge control valve can conceivably be subjected to electrical duty control. In this case, the pressure in the purge line is fluctuated by the opening and closing of the purge control valve, which are repeated intermittently. With this pressure fluctuation, the diaphragm check valve is allowed to repeat opening and closing motions. That is the diaphragm vibrates. Consequently, material fatigue is caused in the flexed portion of the diaphragm. In order to enhance resistance to such material fatigue, a diaphragm made of a special material or subjected to special treatment must be used. Further, the diaphragm is intermittently brought into contact with other members as it vibrates, and abrasion or damage to the other members occurs. Moreover, noise is generated by the vibration.

Another problem is that the entire size of the canister in which the diaphragm check valve is disposed is increased because the diaphragm check valve is larger than the ball check valve. The enlargement of the canister gives rise to a problem in mounting the canister within the limited space of a vehicle.

FIGS. 16 to 18 each show a canister 201 and control valves 204,205,206, which are diaphragm check valves. A partition 202 is disposed in the canister 201 to separate the interior into two chambers 203*a*,203*b*. The first control valve 204, which is connected directly to the first chamber 203*a*, is let open depending on the internal pressure of a fuel tank (not shown). The second control valve 205, which is connected directly to the second chamber 203*b*, is let open to introduce the air into the canister 201. The third control valve 206, which is also connected directly to the second chamber 203*b*, is let open to exhaust the gas containing no fuel from the canister 201.

FIG. 16 shows an up-down flow type canister 201 in which the fuel vapor flows in the vertical direction, when the canister 201 is mounted on a vehicle etc. In FIG. 16, control valve 206 disposed on the top of the canister 201 protrudes beyond the width L of the canister 201.

FIGS. 17 and 18 show a side flow type canister 201 in which the fuel vapor flows in the horizontal direction. Since the height H of this type of canister 201 can be reduced, this canister 201 is easier to mount on a vehicle. However, the control valves 205,206 protrude beyond the total height H of the canister 201.

Here, it is conceivable to connect the control valves 205,206 to the canister 201, for example, via hoses instead of connecting them directly to the canister 201. FIG. 19 shows a case where the control valves 205,206 are connected via hoses 207 to the canister 201. By locating the control valves 205,206 apart from the canister 201, the flexibility in mounting the canister 201 to a vehicle is increased.

However, in this construction, extra parts including the hoses 207, clamps 208, etc. for connecting the control valves 205,206 to the canister 201 are necessary. The added parts increase cost and assembly time. Further, fuel vapor may permeate through the hoses 207.

SUMMARY OF THE INVENTION

Accordingly, it is a primary objective of the present invention to provide a fuel vapor treating apparatus which does not release the fuel vapor into the atmosphere, but collects and treats it in a canister. In this apparatus, diaphragm check valves are employed as control valves. The control valves are provided on the canister so as to control introduction of fuel vapor to the canister, introduction of outside air into the canister and exhaust of a gas from the canister, respectively. This enables treatment of a large amount of fuel vapor and downsizing of the entire apparatus.

It is another objective of the present invention to provide a fuel vapor treating apparatus provided with diaphragm check valves such that unnecessary vibration of the diaphragms is inhibited so as to reduce fatigue in the diaphragms and generation of noise.

To achieve the foregoing and other objects and in accordance with the purpose of the present invention, an apparatus for treating fuel vapor evaporated in a fuel tank is proposed. The apparatus has a canister for collecting a fuel component and allowing a passage of gas, both contained in the fuel vapor supplied to the canister through a vapor line, and an air intake passage communicating an engine. The canister has an inlet port for introducing air thereinto and an outlet port for releasing the gas therefrom based on inner pressure. Fuel vapor is purged to the air intake passage from the purge line through a purge line when the engine is in the operation. The apparatus comprises a first valve device provided with the canister, for selectively opening and closing the inlet port. The first valve device opens the inlet port based on said inner pressure decreased by the fuel vapor purged to the air intake passage from the canister. The apparatus comprise a second valve device provided with the canister, for selectively opening and closing the outlet port. The second valve device opens the outlet port based on inner pressure increased by the fuel vapor introduced to the canister from the fuel tank. The apparatus further comprises at least one of the first and second valve device including a diaphragm check valve.

BRIEF DESCRIPTION OF THE DRAWINGS

The features of the present invention that are believed to be novel are set forth with particularity in the appended claims. The invention, together with the objects and advantages thereof, may best be understood by reference to the following description of the preferred embodiments together with the accompanying drawings in which:

DETAILED DESCRIPTION OF THE PREFERRED EMBODIMENTS

A fuel vapor treating apparatus for a vehicle will be described below according to a first embodiment.

Figure 1:
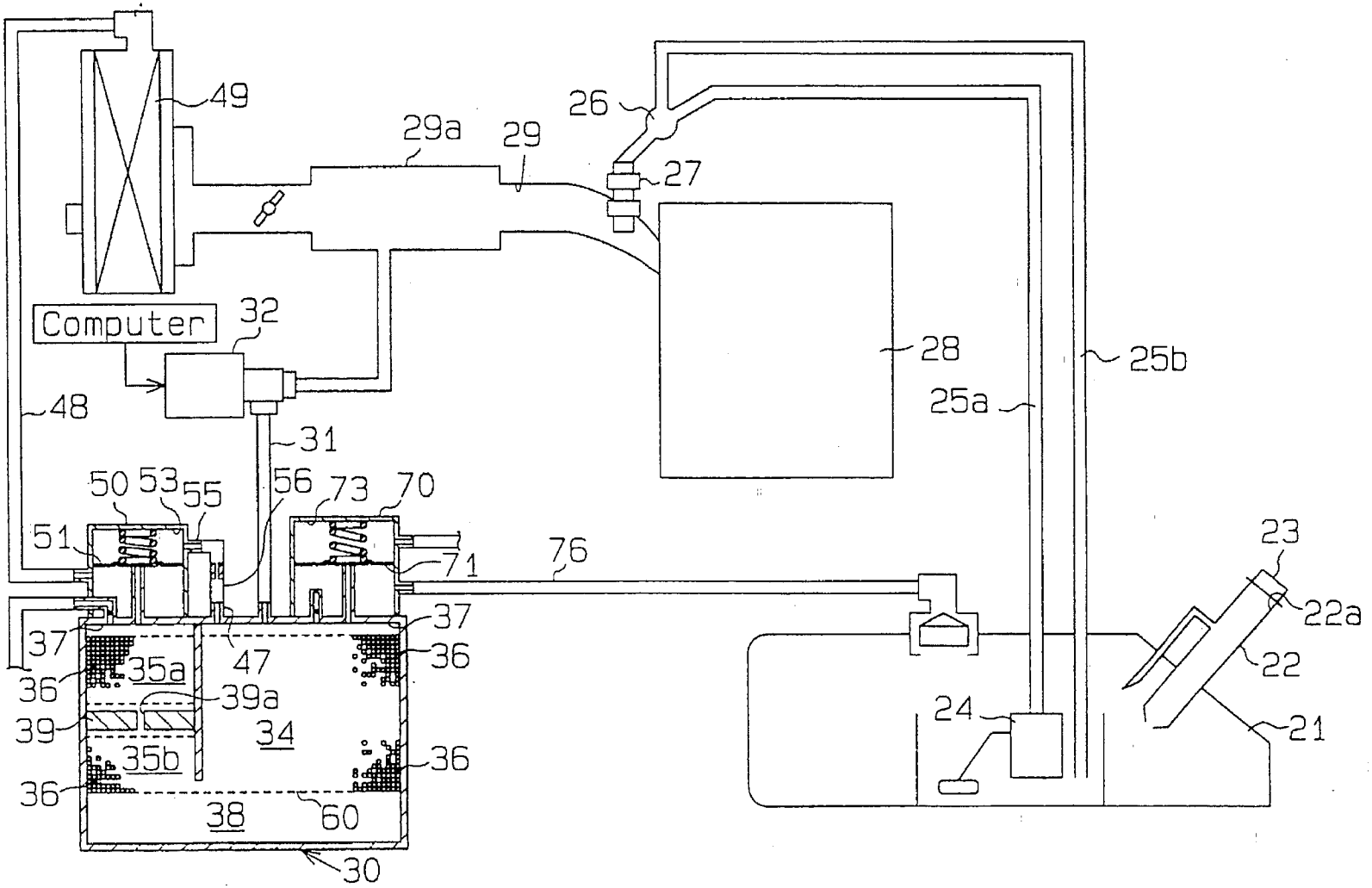
FIG. 1 is a schematic view, partially in cross section of a fuel vapor treating apparatus according to a first embodiment of the invention.

FIG. 1 shows a schematic constitutional view of a fuel vapor treating apparatus according to the first embodiment of the invention. A gasoline engine system for an automobile (not shown) is provided with a fuel tank 21 for storing fuel. The tank 21 has an inlet pipe 22 for charging fuel, i.e. for refueling. The pipe 22 has a fuel port 22*a* at the distal end. An fuel feeding nozzle (not shown) is to be inserted to the fuel port 22*a* when fuel is to be charged to the tank 21. A removable cap 23 is applied to the fuel port 22*a*.

A main line 25*a*, which is extended from a pump 24 housed in the tank 21, is connected to a delivery pipe 26. A plurality of injectors 27 connected to the delivery pipe 26 are located at positions corresponding to a plurality of cylinders of an engine 28. A return line 25*b*, which is extended from the delivery pipe 26, is connected to the tank 21. The fuel delivered from the pump 24 under operation of the pump 24 flows through the main line 25*a* to the delivery pipe 26, where it is distributed to the respective injectors 27. The fuel is injected to intake passages 29 under actuation of the injectors 27, and fed, together with air, to the respective cylinders of the engine 28 for combustion. The surplus fuel remaining in the delivery pipe 26 returns through the return line 25*b* into the tank 21.

Figure 2:
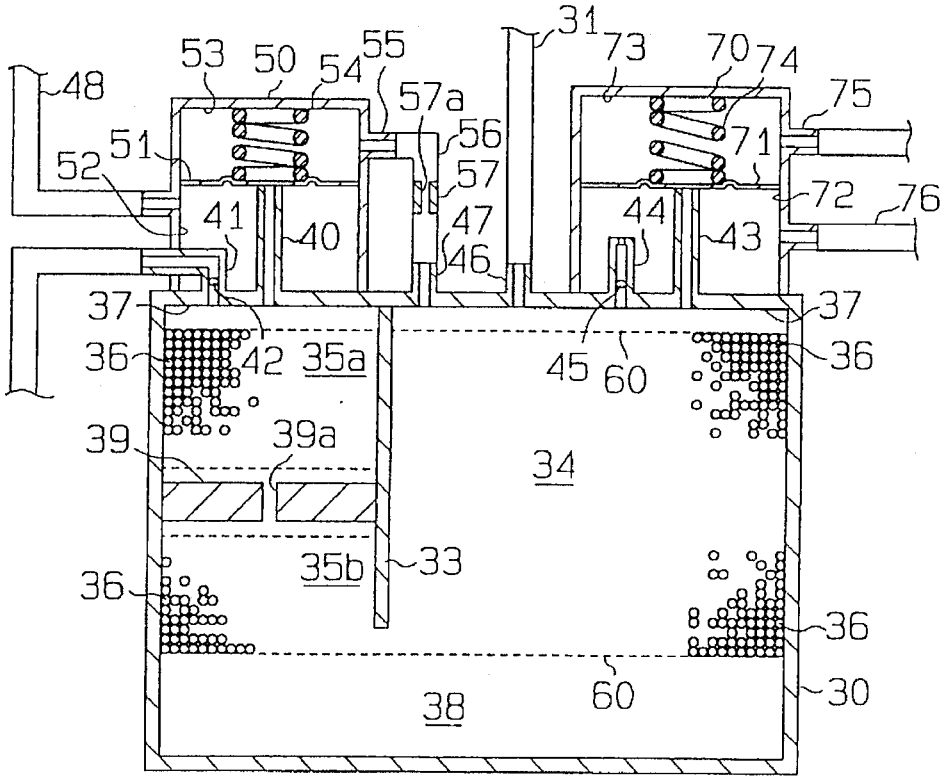
FIG. 2 is a cross-sectional view of a canister in the fuel vapor treating apparatus of FIG. 1.

The system according to this embodiment is provided with a canister 30 in which the fuel vapor formed in the tank 21 is collected by adsorption. The canister 30 will be described referring to FIGS. 2 to 4. A purge line 31 extends from the canister 30 to a surge tank 29*a* in the intake passage 29. The purge line 31 purges the fuel collected in the canister 30 into the surge tank 29*a*. A purge control valve 32, which opens and closes the purge line 31, controls the amount of fuel passing therethrough, i.e. the purge amount. In this embodiment, the purge line 31 has an inner diameter of 8 mm.

In this embodiment, a computer controls the actuation of the purge control valve 32. The computer opens the purge control valve 32 whenever the temperature of the engine cooling water exceeds a predetermined level. Since the purge amount from the canister 30 to the surge tank 29*a* influences the control of the air/fuel ratio in the engine 28, the computer determines the opening of the purge control valve 32 depending on the running condition of the engine 28. Generally, the CO level in the exhaust gas is increased when the air/fuel ratio in the engine 28 is lowered. The oxygen level in the exhaust gas is sensed by an oxygen sensor, and the computer decides the purge amount, i.e. the opening of the purge control valve 32, based on the detected oxygen level. In order to realize more precise valve control, the computer performs duty control of the opening of the purge control valve 32.

A first control valve 50 is disposed on the canister 30. The control valve 50 is a diaphragm check valve for controlling the amount of outside air to be introduced to the canister 30. A second control valve 70 located on the canister 30 is a diaphragm check valve opened by the internal pressure of the tank 21 in excess of a predetermined level. The fuel vapor in the tank 21 is introduced into the canister 30 when the valve 70 is open.

A partition 33 located in the canister 30 separates the inner space thereof into a main chamber 34 having a larger capacity and a sub-chamber 35 having a smaller capacity. An adsorbent 36 is contained in the respective chambers 34,35 and adsorbs the fuel vapor introduced into the canister 30. A couple of filters 60 disposed on opposite sides of the adsorbent 36 retain the adsorbent 36 at a predetermined position. Upper and lower spaces 37,38 in the respective chambers 34,35 contain no adsorbent 36. The lower space 38 communicates with both chambers 34,35. A partition 39 disposed at the center of the sub-chamber 35 separates the sub-chamber 35 into a first sub-chamber 35*a* and a second sub-chamber 35*b*. This partition 39 has a hole 39*a* which connects these two sub-chambers 35*a*,35*b*.

An inlet port 40, provided on the canister 30 at a position corresponding to the location of the first sub-chamber 35*a*, introduces the outside air into the canister 30. An outlet port 41, also provided on the canister 30 at a position corresponding to the location of the first sub-chamber 35*a*, exhausts the gas in the canister 30 to the outside of the apparatus. A ball check valve 42 disposed in the outlet port 41 allows gas to be exhausted from the canister 30 but checks counterflow.

A vapor port 43 is provided on the canister 30 at a position corresponding to the location of the main chamber 34 and introduces the fuel vapor into the canister 30. A vent 44, also provided on the canister 30 at a position corresponding to the location of the main chamber 34, allows gas to flow toward the tank 21 whenever the internal pressure of the tank 21 becomes negative or lower than that of the chamber 34. A ball check valve 45 provided in this vent 44 allows gas to flow from the canister 30 but checks counterflow. A purge port 46 formed on the canister 30 at a position corresponding to the location of the main chamber 34 introduces the fuel released from the adsorbent 36 to the purge line 31. A first pressure port 47 formed on the canister 30, at a position corresponding to the location of the main chamber 34, communicates via the upper space 37 with the purge port 46.

The first control valve 50 selectively opens and closes the inlet port 40. This control valve 50 includes a diaphragm 51 for opening and closing the inlet port 40. The diaphragm 51 separates the inner space of the control valve 50 into a lower pressure chamber 52 and an upper pressure chamber 53. A spring 54, which is located in the upper pressure chamber 53, urges the diaphragm 51 downward. The urging of the spring 54 closes the inlet port 40 with the diaphragm 51. A pipe 48 extending from the lower pressure chamber 52 is connected to an air cleaner 49 located at the inlet of the intake passage 29. Since the outside air introduced into the pressure chamber 52 through the pipe 48 has already passed through the air cleaner 49, the outside air introduced into the pressure chamber 52 contains a very small amount of dust. A second pressure port 55 provided on the upper pressure chamber 53 communicates with the first pressure port 47 via a pressure passage 56, which is a hose.

Figure 3:
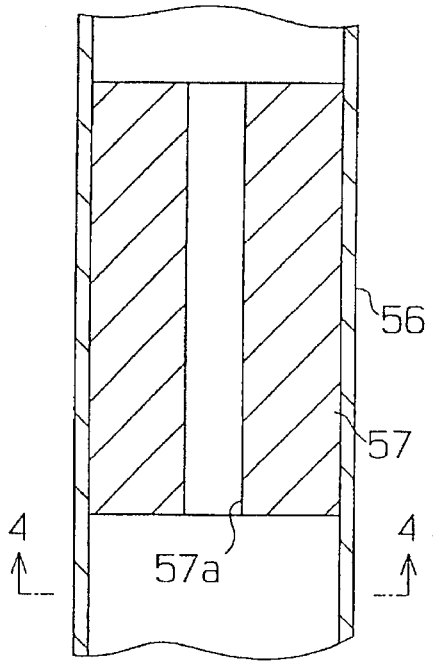
FIG. 3 shows an enlarged cross-sectional view of a pressure passage shown in FIG. 2.
Figure 4:
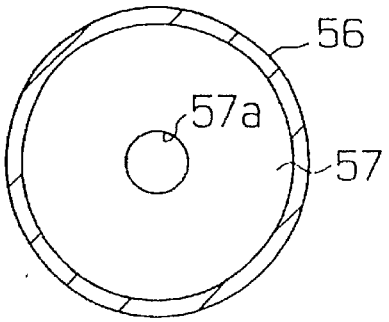
FIG. 4 shows an enlarged cross-sectional view of the pressure passage taken along the line 4—4 in FIG. 3.

In this embodiment, the pressure passage 56 has an inner diameter of 3.5 mm. As shown in FIGS. 3 and 4, a restrictor 57 having a hole 57*a* is provided in the pressure passage 56. In this embodiment, the hole 57*a* has an inner diameter of 0.8 mm. The restrictor 57 is a columnar member having an outer diameter slightly greater than the inner diameter of the pressure passage 56. The restrictor 57 in the pressure passage 56 is fitted inside the pressure passage 56. As will be described later, the restrictor 57 serves to delay transmission of the pressure in the pressure passage 56. In this embodiment, the hole 57*a* is provided with the smallest possible inner diameter so as to increase the resistance of the gas flow and delay transmission of the pressure. The first pressure port 47 and the second pressure port 55 each have an outer diameter slightly greater than 3.5 mm and an inner diameter of 2 mm.

The second control valve 70 selectively opens and closes the vapor port 43. This control valve 70 has a diaphragm 71 for opening and closing the vapor port 43. The diaphragm 71 separates the inner space of the control valve 70 into a lower pressure chamber 72 and an upper pressure chamber 73. A spring 74, which is disposed in the upper pressure chamber 73, urges the diaphragm 71 downward. The urging direction of the spring 74 closes the vapor port 43 with the diaphragm 71. An atmospheric pressure port 75 also provided on the upper pressure chamber 73 communicates with the atmosphere. A vapor line 76 extending from the tank 21 is connected to the lower pressure chamber 72. The control valve 70 closes the vapor port 43 when the internal pressure of the tank 21, which acts against the lower pressure chamber 72 through the vapor line 76, is relatively low, and opens the vapor port 43 when this pressure is higher than a predetermined level.

Next, the operation of the fuel vapor treating apparatus will be described. Initially, the control valves 50,70 are closed and only the check valve 42 can readily be let open.

Fuel vapor evaporated in the tank 21 is collected through the vapor line 76 into the canister 30. When the temperature in the tank 21 is elevated, the fuel is evaporated vigorously to form a fuel vapor, having a large fuel component, in the tank 21. The fuel vapor is introduced to the lower pressure chamber 72 of the second control valve 70 through the vapor line 76. If the pressure level of the fuel vapor pushing up the diaphragm 71 exceeds the atmospheric pressure and the urging force of the spring 74, the vapor port 43 is opened to allow the fuel vapor to be introduced to the main chamber 34 of the canister 30.

The fuel component contained in the fuel vapor introduced to the main chamber 34 is gradually adsorbed on the adsorbent 36 in a process where the fuel vapor permeates through the adsorbent 36. The permeated fuel vapor then flows into the lower space 38 and flows into the second sub-chamber 35*b*. The fuel component of the fuel vapor fed to the second sub-chamber 35*b* is further adsorbed on the adsorbent 36 when the fuel vapor passes through the sub-chamber 35*b*. The fuel vapor flows into the first sub-chamber 35*a* through the communicating hole 39*a* of the partition 39. In this process, since the fuel vapor encounters resistance when it passes through the communicating hole 39*a*, the flow of the fuel vapor from the second sub-chamber 35*b* to the first sub-chamber 35*a* is slightly regulated. Accordingly, the efficiency of adsorbing the fuel vapor by the adsorbent 36 in the main chamber 34 and the second sub-chamber 35*b* is greatly improved.

The fuel component in the fuel vapor is substantially adsorbed on the adsorbent 36 while the fuel vapor passes through the main chamber 34 and the second sub-chamber 35*b*, so that the gas reaching the first sub-chamber 35*a* contains little or no fuel. Even if the gas still contains some fuel, the adsorbent 36 in the first sub-chamber 35*a* readily adsorbs it. Accordingly, the gas that reaches the upper space 37 of the first sub-chamber 35*a* has no fuel component. Then, the gas is, as necessary, exhausted to the atmosphere through the check valve 42 and outlet port 41.

In this process, a flow of gas from the vapor port 43 toward the inlet port 40 is formed in the canister 30. Accordingly, the diaphragm 51 of the first control valve 50 is pushed up based on the pressure of the gas flow. However, a pressure, which is as great as the pressure applied to the lower surface of the diaphragm 51, is applied to the upper pressure chamber 53 through the pressure passage 56. Accordingly, the diaphragm 51 is not moved and the inlet port 40 is not opened to allow backward flowing of the fuel vapor toward the air cleaner 49.

Meanwhile, when the tank 21 is cooled as a result of parking the automobile for a long time, the formation of fuel vapor in the tank 21 stops. If the internal pressure of the canister 30 becomes higher than the internal pressure of the tank 21, the check valve 45 opens the vent 44. Thus, the gas in the canister 30 can flow into the tank 21.

Next, the situation where the fuel vapor adsorbed in the canister 30 is to be purged to the surge tank 29*a* through the purge line 31 will be described. When the engine 28 is started, the air passed through the air cleaner 49 flows through the intake passage 29 to be fed to the respective cylinders of the engine 28. In this process, a negative pressure is applied to the purge line 31. If the purge control valve 32 is opened in this state, the negative pressure in the purge line 31 is communicated with the main chamber 34 of the canister 30. This negative pressure can be used to create a flow of gas from the canister 30 toward the surge tank 29*a*.

The purge port 46 and the pressure port 47 communicate with each other through the upper space 37. Accordingly, the negative pressure from the purge port 46 is directed to the upper pressure chamber 53 of the first control valve 50 through the pressure passage 56. The diaphragm 51 is shifted up by this negative pressure against the urging force of the spring 54 to open the inlet port 40.

Since the computer performs duty control of the purge control valve 32 in this embodiment, the purge control valve 32 repeats intermittent opening and closing motions. Accordingly, the pressure in the purge line 31 fluctuates every time the purge control valve 32 repeats opening and closing motions to generate pulsation in the gas flow in the purge line 31. This pressure fluctuation is transmitted from the upper space 37 in the canister 30 through the pressure passage 56 to the upper pressure chamber 53, so that the diaphragm 51 is vibrated. To counter the vibration, in this embodiment, the pressure passage 56 is provided with the restrictor 57. The inner diameter of the hole 57*a* of the restrictor 57 is extremely small compared with that of the purge line 31. Consequently, the resistance of the gas passing through the hole 57*a* is increased and the pressure of the gas is not directly transmitted through the restrictor 57.

Accordingly, the pressure fluctuation occurring in the purge line 31 is moderated by the restrictor 57 before being transmitted to the upper pressure chamber 53. Thus, pressure fluctuation acting upon the diaphragm 51 is reduced, and unnecessary vibration of the diaphragm 51 attributable to such pressure fluctuation is prevented. Since the diaphragm 51 is prevented from vibrating, the fatigue caused at the flexible portion of the diaphragm 51 is reduced. Thus, there is no particular need for improving the flexural fatigue resistance of the diaphragm 51. Further, as the vibration of the diaphragm 51 is prevented, damage or abrasion of the inlet port 40 and the diaphragm 51 is reduced.

Figure 5:
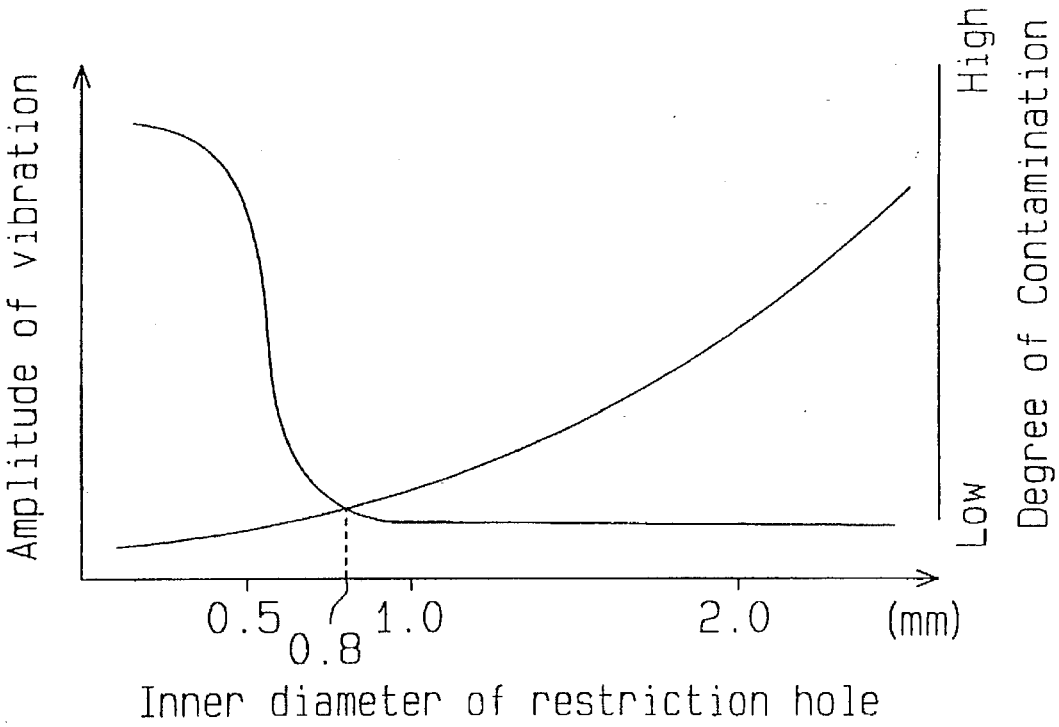
FIG. 5 is a graph showing the relationship between the inner diameter of the restriction hole provided in the pressure passage of FIG. 3 and the vibration amplitude of the diaphragm, as well as, the relationship between the inner diameter of the restriction hole and the degree of contamination of the hole.

Now, the relationship between the vibration of the diaphragm 51 and the inner diameter of the hole 57*a* of the restrictor 57, as well as, the relationship between the degree of contamination of the hole 57*a* and the inner diameter thereof will be described with reference to the graph of FIG. 5. In this graph, the ordinate shows the vibration amplitude of the diaphragm 51 and the contamination degree of the restrictor 57; whereas the abscissa shows the inner diameter of the hole 57*a*. A curve showing the relationship between the vibration amplitude of the diaphragm 51 and the inner diameter of the hole 57*a* is sloping downward toward the left. Thus, the smaller the diameter of the hole 57*a*, the smaller the vibration amplitude. Further, the vibration amplitude when the inner diameter is 1 mm is about a third of the amplitude when the inner diameter is 2 mm. The resistance of the gas passing through the hole 57*a* is increased as the inner diameter of the hole 57*a* becomes smaller to delay the speed that the pressure is transmitted through the restrictor 57, thus preventing vibration of the diaphragm 51.

A curve showing the relationship between the degree of contamination of the hole 57*a* and the inner diameter thereof is sloping downward toward the right, and the curve inflects when the inner diameter of the hole 57*a* is about 0.5 mm.

When the inner diameter is smaller than 0.5 mm, the amount of gas passing through the hole 57*a* is small, and a particle, once deposited to the hole 57*a*, promotes contamination as a nucleus. On the other hand, when the inner diameter is greater than 0.5 mm, the amount of the gas passing through the hole 57*a* will be enough to inhibit deposition of a particle.

Therefore, the inner diameter of the hole 57*a* of the restrictor 57 is desirably designed to be as small as possible, provided that it is greater than 0.5 mm. Accordingly, in this embodiment, the range around the point that these two curves intersect each other, i.e. 0.8 mm, is employed as a suitable inner diameter of the hole 57*a*.

In the first control valve 50, when the diaphragm 51 is shifted up, the inlet port 40 is let open. The relatively low pressure transmitted to the main chamber 34 is further transmitted through the lower space 38 of the canister 30 to the second sub-chamber 35*b* and the first sub-chamber 35*a*, so that the internal pressure of the canister 30 becomes lower than the outside air pressure (atmospheric pressure). Outside air introduced through the air cleaner 49 to the pipe 48 is introduced to the lower pressure chamber 52 of the first control valve 50 and further to the canister 30 through the inlet port 40. Since the outside air introduced to the lower pressure chamber 52 has already passed through the air cleaner 49, it contains substantially no dust. Accordingly, since no dust is caught between the inlet port 40 and the diaphragm 51, the airtightness between the inlet port 40 and the diaphragm 51 is not reduced nor is the inlet port 40 and the diaphragm 51 worn. Thus, the durability of the first control valve 50 is improved.

The outside air introduced to the canister 30 passes successively through the first sub-chamber 35*a*, the communicating hole 39*a* of the partition 39 and the second sub-chamber 35*b* and reaches the lower space 38. In this process, the fuel adsorbed on the adsorbent 36 in the respective sub-chambers 35*a*,35*b* is released from the adsorbent 36 into the outside air. The outside air then flows toward the main chamber 34, and the fuel adsorbed on the adsorbent 36 is released into the outside air as it passes through the main chamber 34, so that the outside air becomes a gas rich in fuel. The gas then reaches the upper space 37, flows through the purge port 46 into the purge line 31, and is purged to the surge tank 29*a*.

Since a diaphragm check valve is employed as the first control valve 50, the inlet port 40 may have a large diameter as compared with the case where a ball check valve is employed. Consequently, a large amount of outside air can be introduced through the inlet port 40 to the canister 30, and thus the efficiency of releasing the fuel from the adsorbent 36 is improved. Therefore, the adsorbent 36 can constantly be maintained in a condition where it can readily adsorb fuel vapor.

Next, the fuel vapor treating apparatus will be described according to the second embodiment of the invention. In this embodiment, the parts similar to those in the first embodiment are given the same reference numbers, and a detailed description thereof will be omitted. The following description will mainly be of how the second embodiment differs from the first embodiment.

Figure 6:
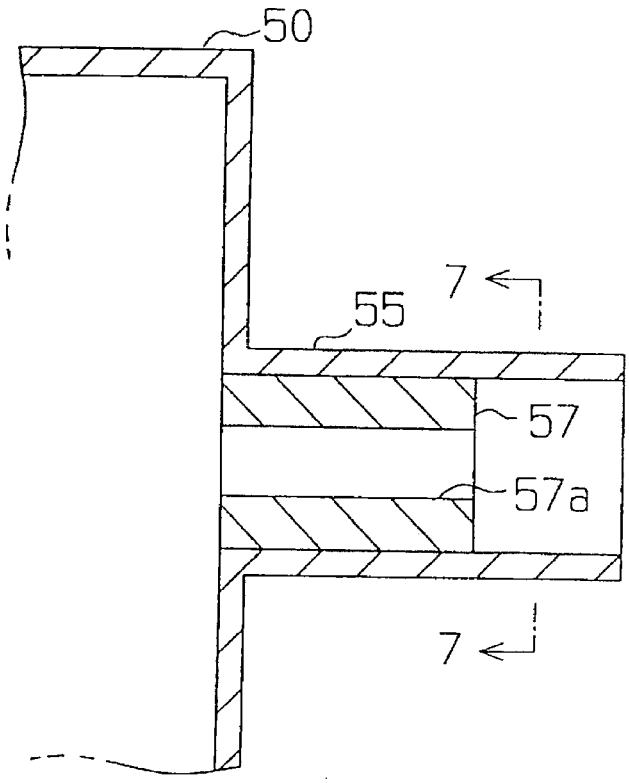
FIG. 6 shows a cross-sectional view of the pressure passage according to a second embodiment of the invention.
Figure 7:
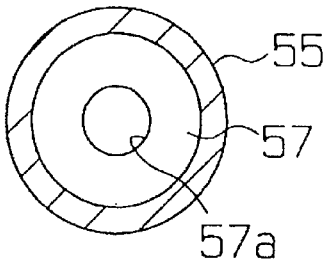
FIG. 7 shows a cross-sectional view of the pressure passage taken along the line 7—7 of FIG. 6.

In the second embodiment, the restrictor 57 is disposed in the second pressure port 55. FIGS. 6 and 7 show enlarged cross-sectional views of the pressure port 55. The restrictor 57 is disposed at the proximal end portion of the pressure port 55, and the hole 57*a* of the restrictor 57 has an inner diameter of 0.8 mm. When the casing of the control valve 50 is molded, this restrictor 57 is formed integrally therewith. While the restrictor 57 is preferably provided at the proximal end portion of the pressure port 55, for convenience's sake in molding, it may be provided apart from the proximal end. In this embodiment, since the restrictor 57 is molded integrally with the casing of the control valve 50, the production process can be simplified. The operation of the system according to this embodiment is the same as in the first embodiment.

Next, the fuel vapor treating apparatus will be described according to the third embodiment. In the following description, the process where fuel vapor formed in the fuel tank during refueling is delivered to the canister and the fuel component contained in the fuel vapor is collected will be referred to as ORVR treatment (ORVR: Onboard Refueling Vapor Recovery). The process where the fuel vapor is treated in the steady state, excluding the refueling state, is referred to as steady state treatment.

Figure 8:
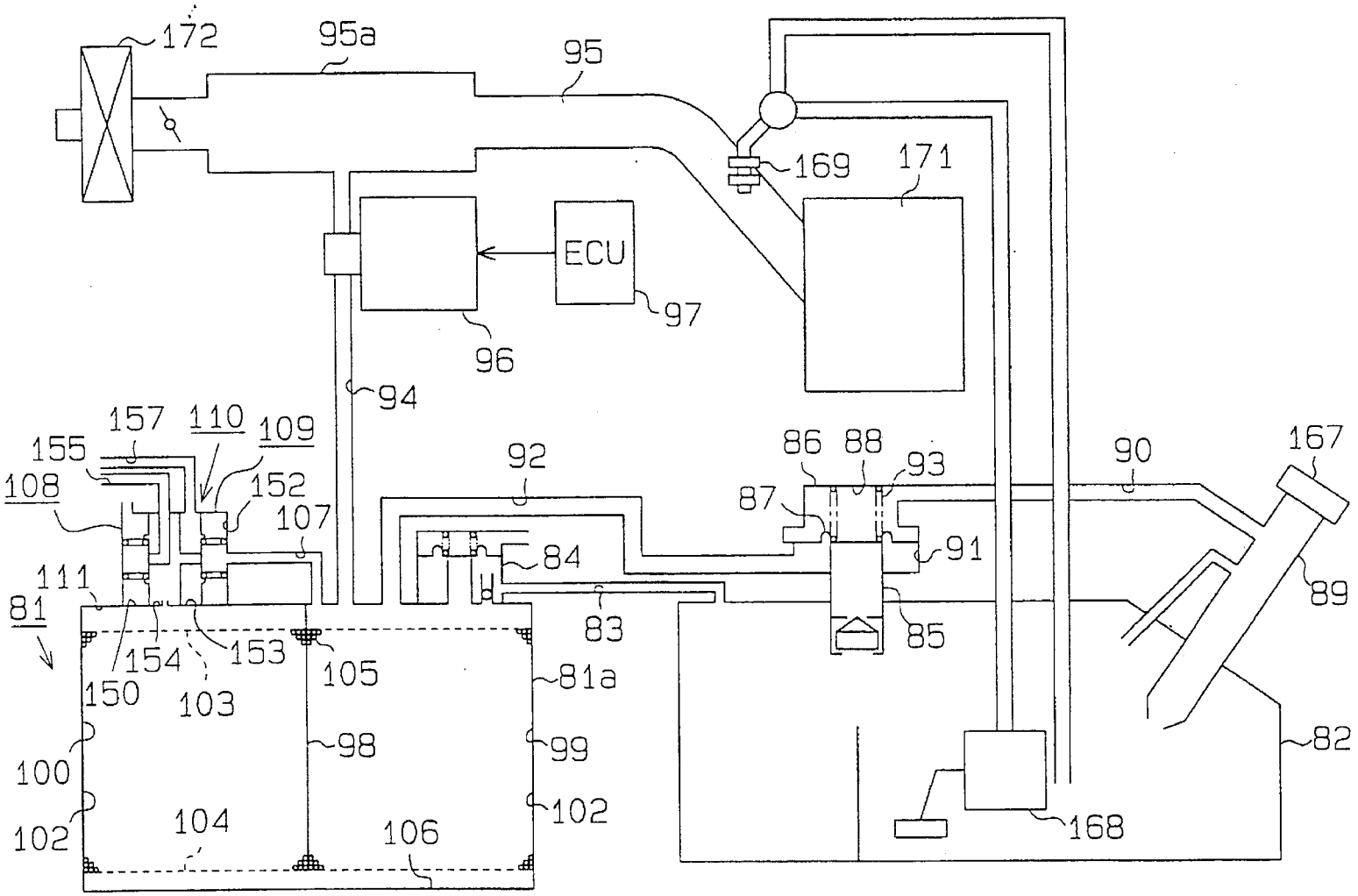
FIG. 8 shows a schematic view of the fuel vapor treating apparatus according to a third embodiment of the invention.
Figure 9:
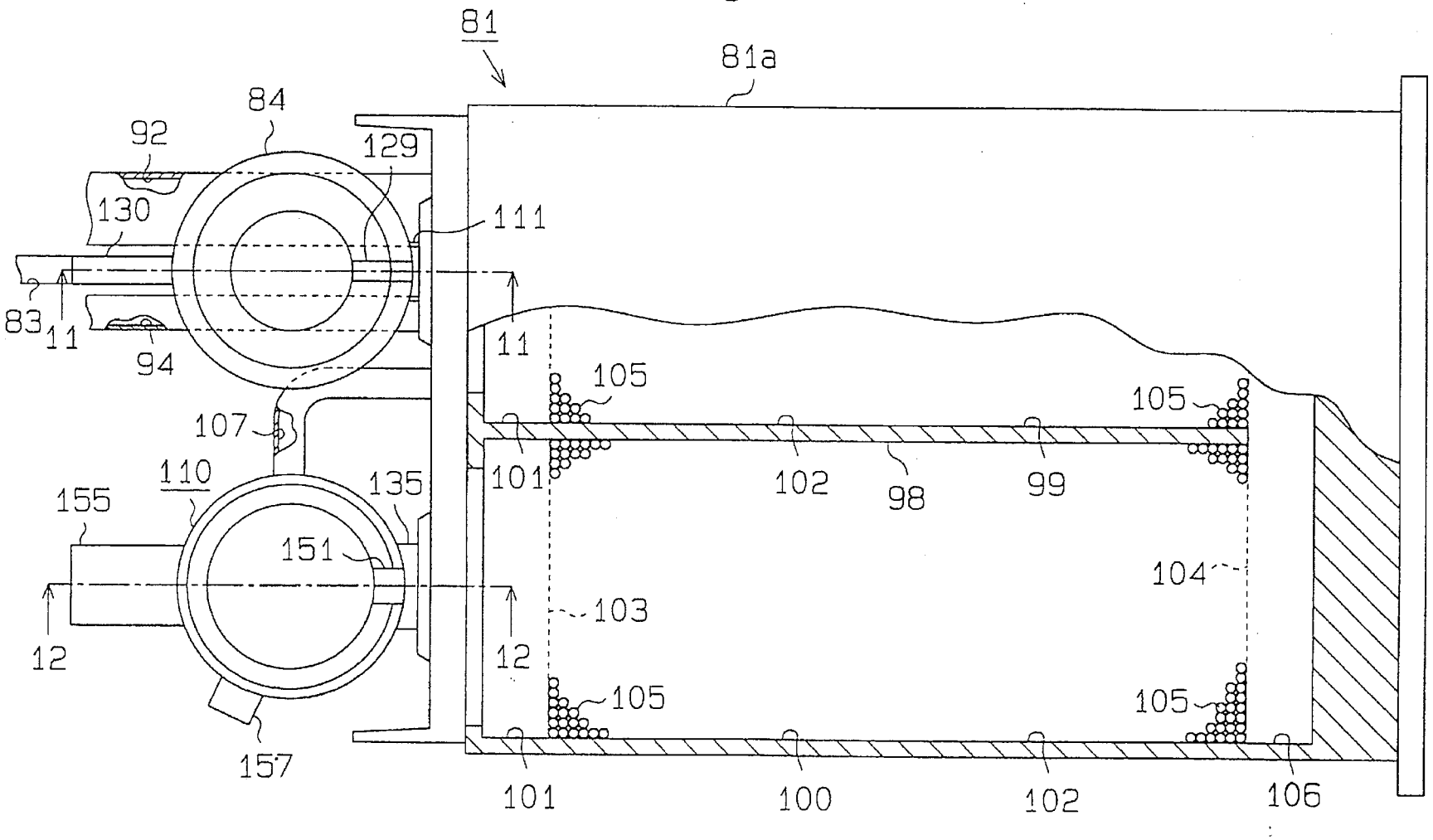
FIG. 9 shows a partially cut-away plan view of the canister of FIG. 8.

FIG. 8 shows a schematic view of the fuel vapor treating apparatus according to the third embodiment. This apparatus includes a canister 81 for collecting fuel vapor therein. For convenience's sake in description, FIG. 8 shows an up-down flow type canister 81 where the fuel vapor flows in the vertical direction. However, the canister 81 is preferably the side flow type, as shown in FIG. 9, where the fuel vapor flows in the horizontal direction. The canister 81 is provided, on one side thereof, with a first control valve 84 and a second control valve 110.

As shown in FIG. 8, a vapor line 83 extending from a fuel tank 82 introduces the fuel vapor formed in the tank 82 into the canister 81. The vapor line 83 is connected to the canister 81 via the first control valve 84 provided on the canister 81. The control valve 84 is opened whenever the internal pressure of the tank 82 exceeds a predetermined level so as to introduce the fuel vapor in the tank 82 into the canister 81. The control valve 84 is a diaphragm check valve.

A breather pipe 85 is provided on the tank 82 and extends perpendicularly upward. The top of the breather pipe 85 is covered by a differential pressure regulating valve 86 which is opened during refueling. This valve 86 is also a diaphragm check valve and has a diaphragm 87 therein. The diaphragm 87 separates the inner space of the valve 86 into an upper pressure chamber 88 and a lower pressure chamber 91. A pressure passage 90 extending from the upper or first pressure chamber 88 is connected to an inlet pipe 89 provided on the tank 82. A breather line 92 extending from the lower or second pressure chamber 91 is connected to the canister 81. A coil spring 93 located in the first pressure chamber 88 urges the diaphragm 87 downward. This urging direction of the coil spring 93 closes the breather pipe 85 with the diaphragm 87.

A large amount of fuel vapor passes through the breather line 92 and flows into the canister 81 during refueling. The amount of the fuel vapor which passes through the breather line 92 during the ORVR treatment is about 50 times as great as that which passes through the vapor line 83 during the steady state treatment. Accordingly, the cross-sectional area of the breather line 92 is designed to be about 10 times as great as that of the vapor line 83.

A purge line 94 extending from the canister 81 is connected to a surge tank 95*a*, which partly constitutes an air intake passage 95. A purge control valve 96, which is located in the purge line 94, controls the purge amount of the fuel to the surge tank 95*a*. An ECU (Electronic Control Unit) 97 controls the purge amount by controlling the opening of the purge control valve 96.

FIG. 9 shows a side flow type canister 81 according to this embodiment. The canister 81 has a casing 81*a* and a partition 98 disposed in the casing 81*a*. The partition 98 separates the inner space of the casing 81*a* into two chambers 99,100. An air layer 101 is formed on one side (left side) of these two chambers 99,100 and contains air. An adsorbent layer 102, which is disposed adjacent to the air layer 101, contains an activated carbon adsorbent 105. A couple of filters 103,104 are disposed on each side of the adsorbent layer 102 supporting the adsorbent layer 102 therebetween. A diffusion chamber 106, provided adjacent to the filter 104, contains air and communicates between these two chambers 99,100.

Figure 10:
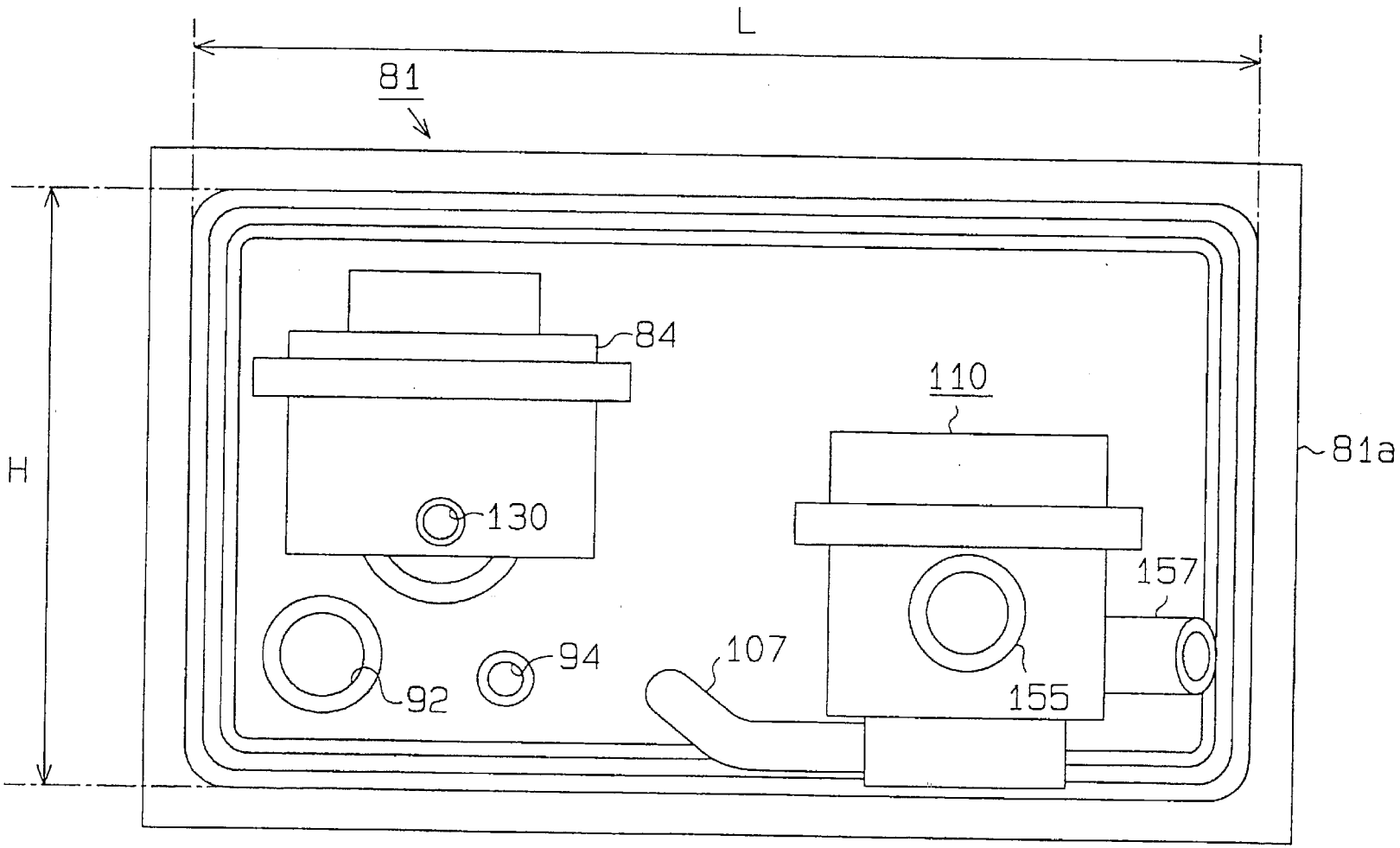
FIG. 10 shows a side view of the canister of FIG. 9.

As shown in FIGS. 9 and 10, the first control valve 84 is fitted on one side of the casing 81*a* at a position corresponding to the location of the first chamber 99 and is connected to the breather line 92 and the purge line 94. One end of a pressure passage 107 is connected to the first chamber 99 at a position adjacent to the purge line 94, while the other end of the passage 107 is connected to a pressure chamber 152 of an air inlet valve 109 (to be described later). The second control valve 110 is fitted on one side of the casing 81*a* corresponding to the location of the second chamber 100. This control valve 110 is formed integrally with a gas release valve 108 and an air inlet valve 109.

Figure 11:
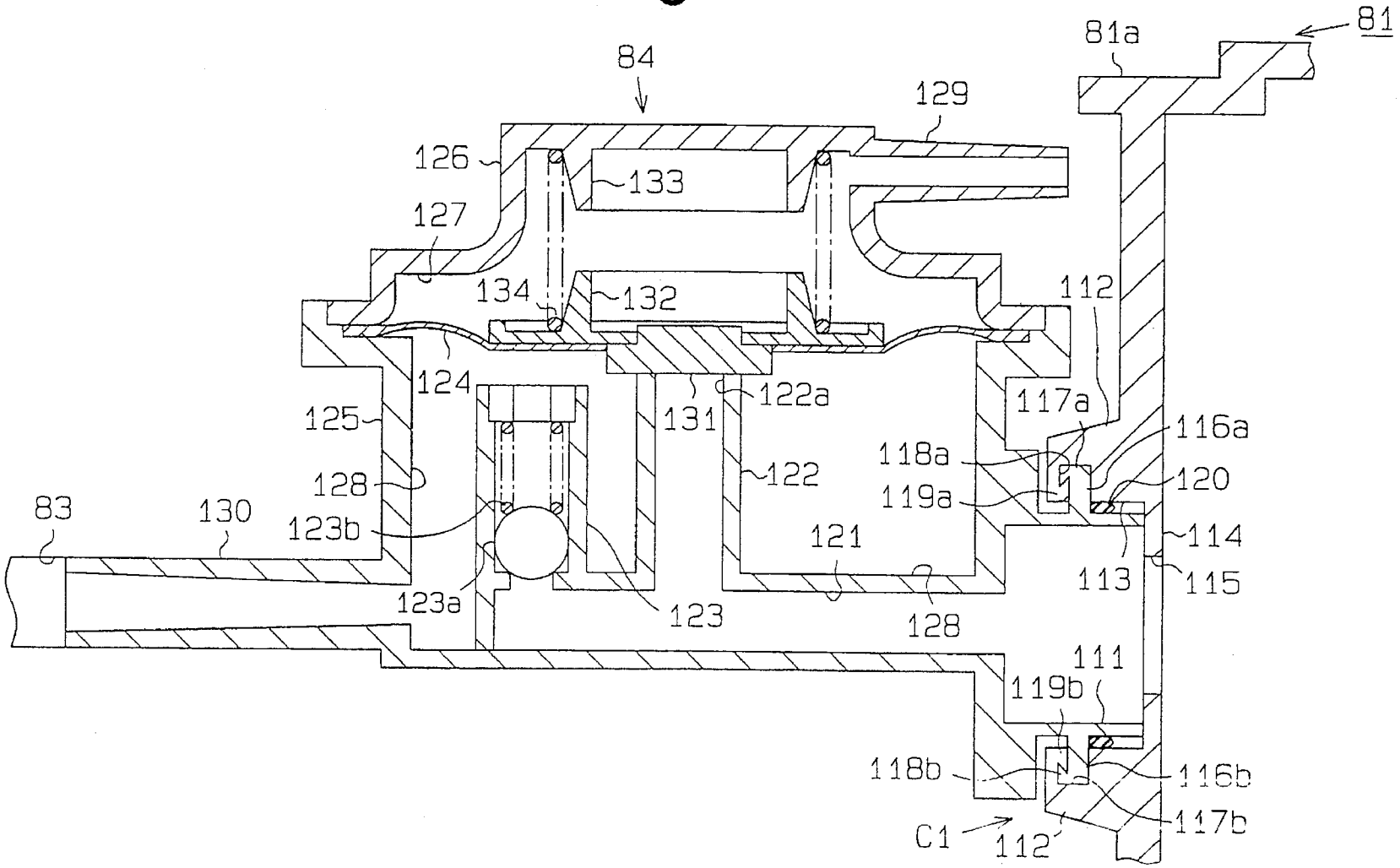
FIG. 11 shows a cross-sectional view taken along the line 11—11 in FIG. 9.

FIG. 11 shows a cross-sectional view of the first control valve 84 taken along the line 11—11 in FIG. 9. This control valve 84 is designed to be detachable from the casing 81*a*, and fitted to the casing 81*a* at the connecting section C1. A pressure pipe 111 introduces the fuel vapor into the canister 81. A thick portion 112 formed on the side wall of the casing 81*a* is provided with a fitting hole 113, and the pressure pipe 111 is inserted to the fitting hole 113. The fitting hole 113 has an inward flange 114. The inner end of the pressure pipe 111 inserted to the fitting hole 113 is abutted against the inward flange 114. The opening formed by the inner circumference of the inward flange 114 communicates between the canister 81 and the control valve 84 to constitute a vapor port 115 for introducing the fuel vapor.

The pressure pipe 111 has a pair of protrusions 116*a*, 116*b* on the outer circumference thereof. A pair of grooves 117*a*,117*b*, which engage with the protrusions 116*a*,116*b*, are formed on the inner circumference of the fitting hole 113. The protrusions 116*a*,116*b* are fitted in the grooves 117*a*, 117*b*, respectively. The protrusions 116*a*,116*b* and the grooves 117*a*,117*b* are provided with stoppers 118*a*,118*b* and stoppers 119*a*,119*b*, respectively. The engagement between the stoppers 118*a*,118*b* with the stoppers 119*a*, 119*b*, respectively, achieves coupling between the protrusions 116*a*,116*b* and the grooves 117*a*,117*b*, respectively. Thus, shifting of the pressure pipe 111 in the axial direction and in the circumferential direction can be regulated. An O-ring 120 fitted on the outer circumference of the pressure pipe 111 seals between the pressure pipe 111 and the fitting hole 113.

Figure 13:
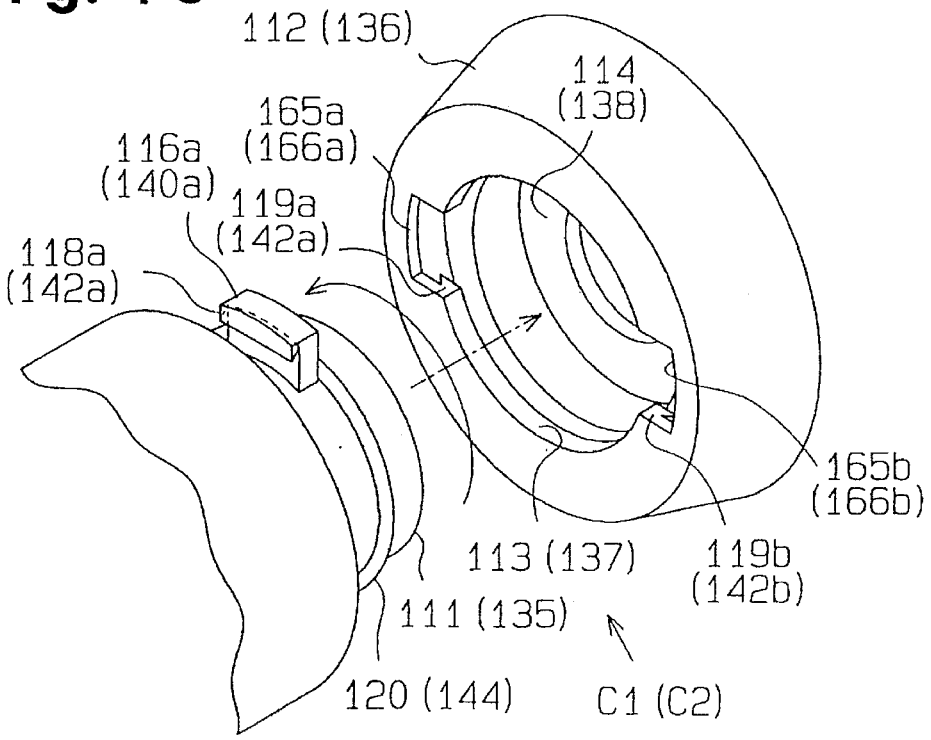
FIG. 13 is a perspective view of a control valve according to the third embodiment of the invention, showing the valve about to be fitted.
Figure 14:
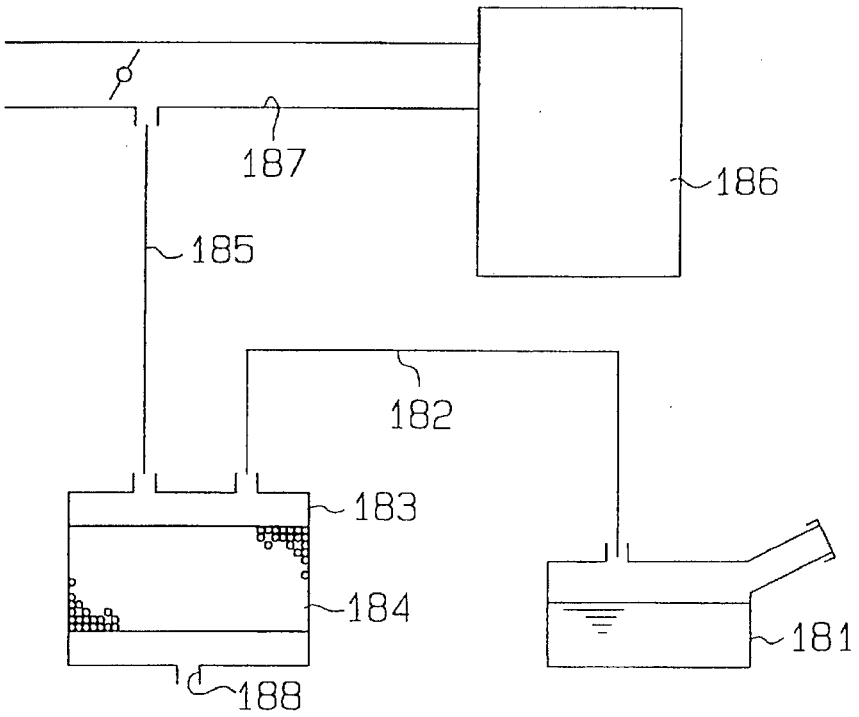
Fig. 14 (Prior Art)
FIG. 14 shows a schematic view of a prior art basic fuel vapor treating system.
Figure 15:
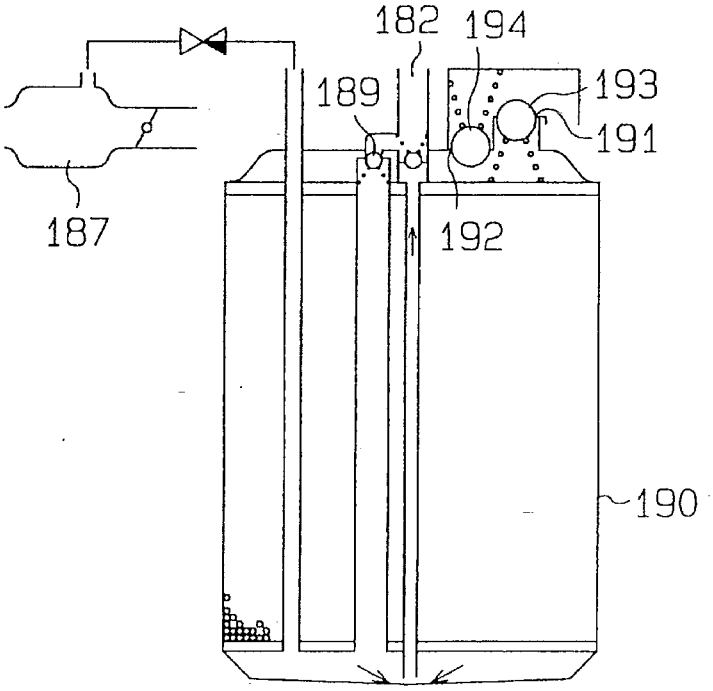
Fig. 15 (Prior Art)
FIG. 15 shows a schematic view of another prior art fuel vapor treating system.
Figure 16:
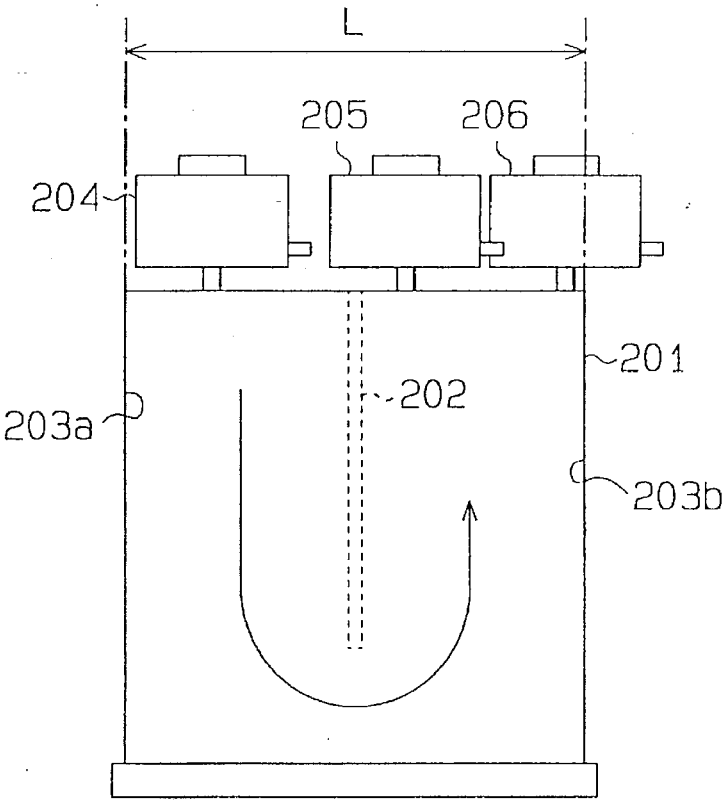
Fig. 16 (Prior Art)
FIG. 16 is a front view showing the arrangement of the canister and control valves in a prior art fuel vapor treating system.
Figure 17:
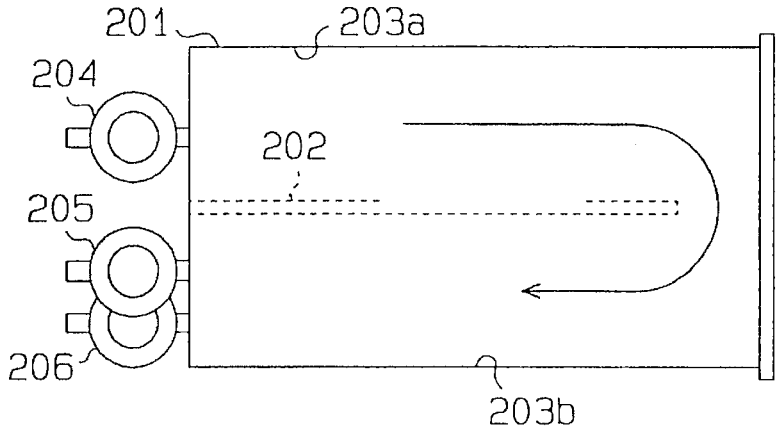
Fig. 17 (Prior Art)
FIG. 17 is a plan view showing the arrangement of the canister and control valves in a prior art fuel vapor treating system.
Figure 18:
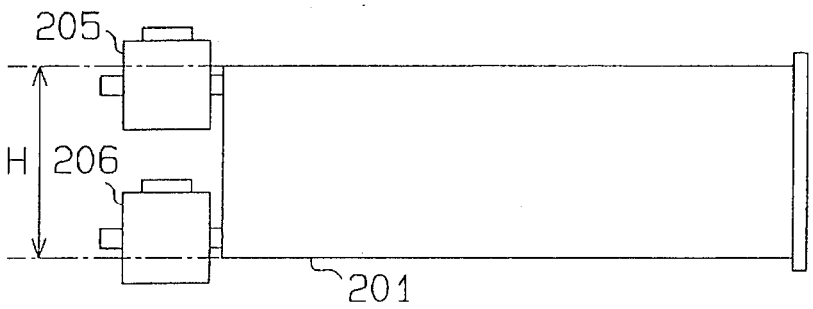
Fig. 18 (Prior Art)
FIG. 18 is a front view showing the arrangement of the canister and control valves in a prior art fuel vapor treating system.
Figure 19:
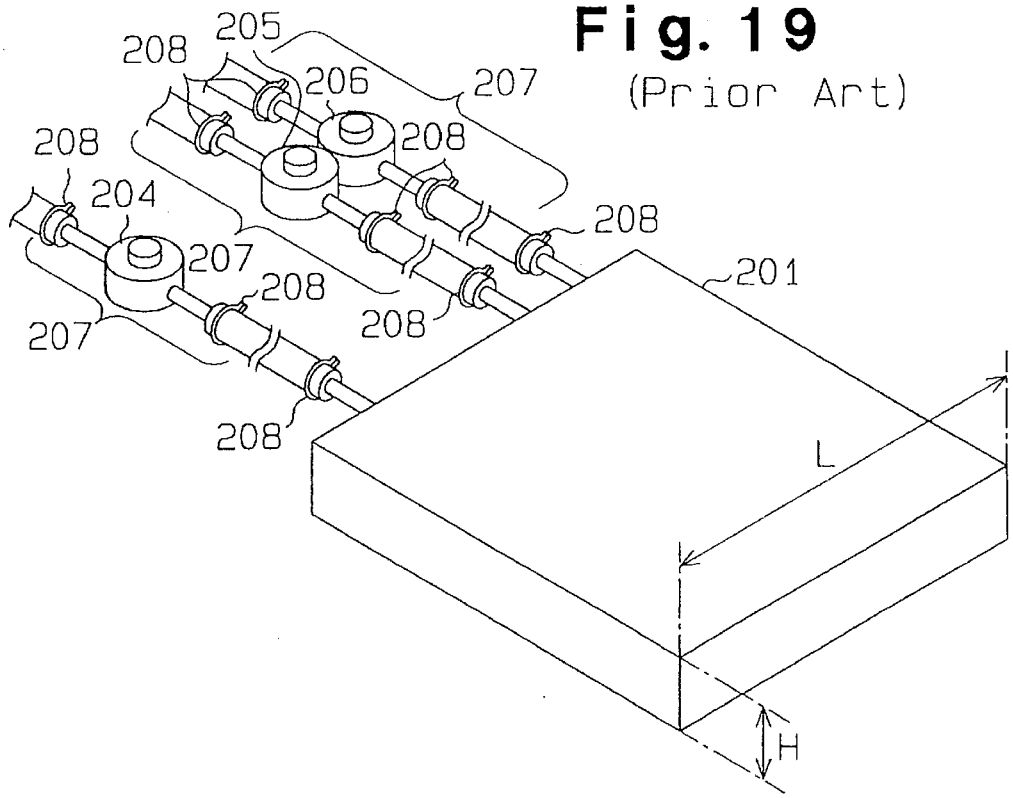
Fig. 19 (Prior Art)
FIG. 19 is a perspective view showing the arrangement of the canister and control valves in a prior art fuel vapor treating system.

FIG. 13 shows in perspective view the structure of the connecting section C1, illustrating how the control valve 84 is fitted to the casing 81*a*. A pair of notches 165*a*,165*b* are formed on the front end face of the thick portion 112 (the left end face of the thick portion 112 in FIG. 11) along the edge of the fitting hole 113, and these notches 165*a*,165*b* have a shape to allow insertion of the protrusions 116*a*,116*b* formed on the pressure pipe 111.

When the control valve 84 is to be fitted on the casing 81*a*, the pressure pipe 111 is inserted to the fitting hole 113. In this process, the control valve 84 is turned by about 90° on the axis of the pressure pipe 111, as indicated by the solid-line arrow in FIG. 13, so that the protrusions 116*a*,116*b* of the pressure pipe 111 may pass through the notches 165*a*,165*b* respectively. After the pressure pipe 111 is inserted to the fitting hole 113, the inner end of the pipe 111 is abutted against the inward flange 114. In this state, the control valve 84 is turned in the opposite direction against the casing 81*a*, while the protrusions 116*a*,116*b* are fitted in the grooves 117*a*,117*b*, respectively. Now, fitting of the control valve 84 is completed. Thus, the control valve 84 is removably attached to casing 81*a* at the connecting section C1 thereof. Since the O-ring 120 is present at the connecting section C1 in this state, the fuel vapor in the canister 81 is prevented from leaking through the connecting section C1 to the outside.

Next, the structure of the control valve 84 will be described. As shown in FIG. 11, the pressure pipe 111 communicates with a guide passage 121 defined in a housing 125 of the control valve 84. The guide passage 121 and the first chamber 99 are allowed to communicate with each other via the pressure pipe 111 and the vapor port 115 when the control valve 84 is fitted to the casing 81*a*. A pressure pipe 122 is provided to intersect the guide passage 121, and a check ball type relief valve 123 is located to the outer extremity of the guide passage 121. The relief valve 123 is provided with a check ball 123*a* and a spring 123*b* for urging the check ball 123*a* downward.

A diaphragm 124 located in the control valve 84 is a flexible disc. The diaphragm 124 is retained at its periphery between the housing 125 of the control valve 84 and a cover 126. The diaphragm 124 separates the inner space of the control valve 84 into two pressure chambers. The space defined between the diaphragm 124 and the cover 126 is an atmospheric pressure chamber 127, while the space defined between the diaphragm 124 and the housing 125 is a positive pressure chamber 128.

An air port 129 formed on the cover 126 introduces atmospheric pressure to the atmospheric pressure chamber 127. Meanwhile, an evaporation pipe 130 formed at the lower position of the housing 125 communicates through the vapor line 83 with the tank 82 so that the positive pressure chamber 128 communicates with the tank 82.

A valve plate 131 applied to the center of the diaphragm 124 closes the open end 122*a* of the pressure pipe 122. A coil spring 134, interposed between a spring retainer 132 disposed at the center of the diaphragm 124 and an annular ridge 133 formed on the lower surface of the cover 126, urges the valve plate 131 downward. The urging direction of this spring 134 closes the open end 122*a* with the valve plate 131. Accordingly, when the difference between the internal pressure of the tank 82 in the positive pressure chamber 128 and the atmospheric pressure in the atmospheric pressure chamber 127 is below a predetermined level, the control valve 84 is closed. Meanwhile, when the internal pressure of the tank 82 drops below a predetermined level, the check ball 123*a* of the relief valve 123 is shifted up against the urging force of the spring 123*b* to allow the air in the canister 81 into the tank 82.

Figure 12:
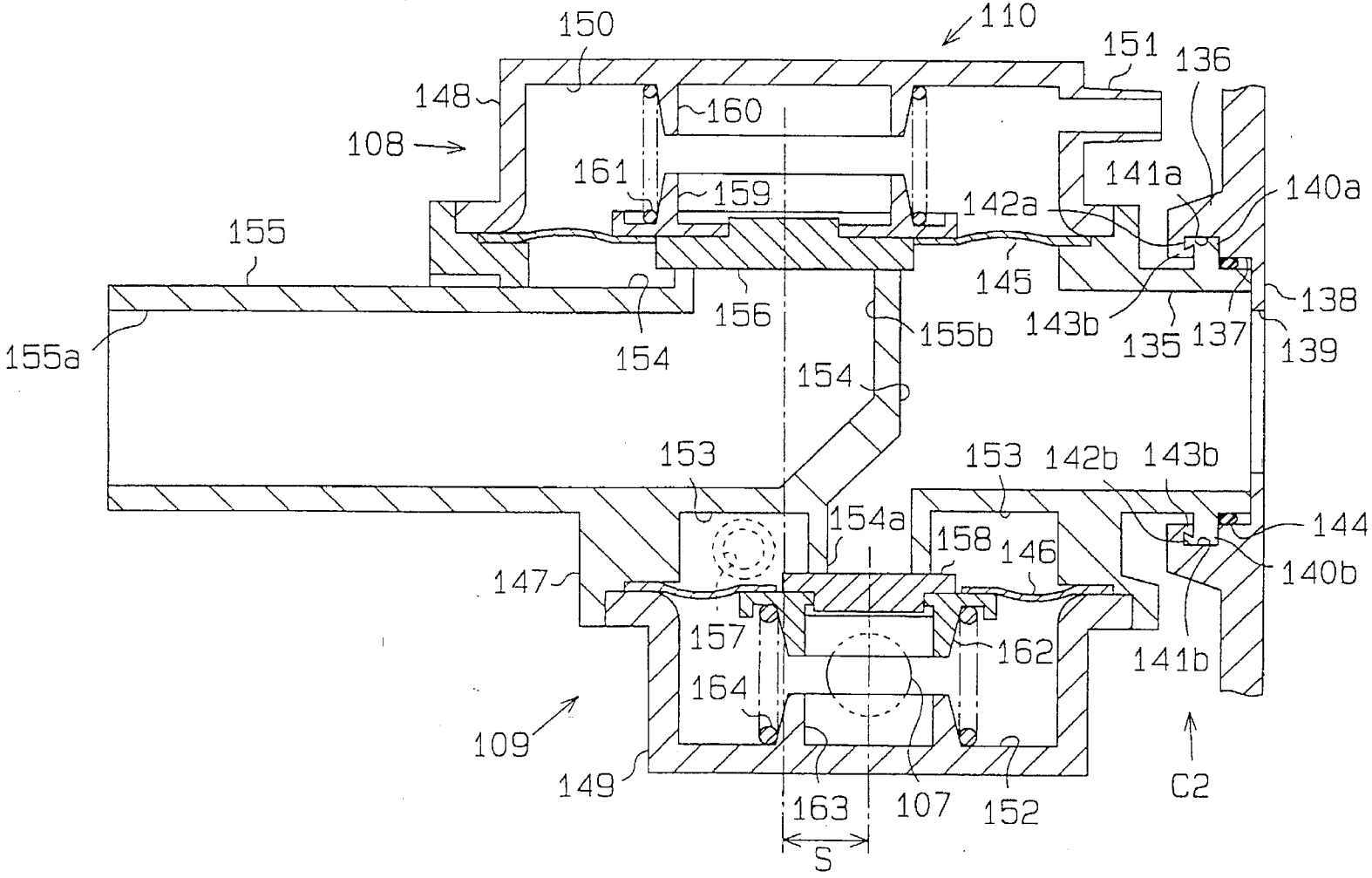
FIG. 12 shows a cross-sectional view taken along the line 12—12 in FIG. 9.

As shown in FIGS. 9 and 10, the second control valve 110 is located on one side of the casing 81*a* at a position corresponding to the location of the second chamber 100. FIG. 12 is a cross-sectional view of the control valve 110 taken along the line 12—12 of FIG. 9. The control valve 110 is designed to be detachable from the casing 81*a*, and fitted to the casing 81*a* at the connecting section C2, as shown in FIG. 12. A pressure pipe 135 is connected to a housing 147 of the control valve 110 and introduces the outside air into the canister 81 or exhausts the residual gas left after collection of the fuel component in the canister 81. The connecting section C2 will be described below only briefly because it has the same structure as that of the connecting section C1.

A thick portion 136 having a fitting hole 137 is formed on one side of the casing 81*a*. The fitting hole 137 has an inward flange 138, and the inner circumference of the flange 138 constitutes an atmospheric port 139. A couple of protrusions 140*a*,140*b* formed on the outer circumference of the pressure pipe 135 are fitted in grooves 141*a*,141*b* of the fitting hole 137. The protrusions 140*a*,140*b* are engaged with the grooves 141*a*,141*b* by their stoppers 142*a*,142*b* and stoppers 143*a*,143*b*, respectively. Relative shifting of the pressure pipe 135 and the casing 81*a* is prevented by the engagement of these stoppers 142*a*,142*b* with the stoppers 143*a*,143*b*. An O-ring 144 fitted on the pressure pipe 135 seals between the pressure pipe 135 and the fitting hole 137. The control valve 110 is removably attached to the casing 81*a* at the connecting section C2. The control valve 110 can be attached in the same manner as in the case of the first control valve 84. In FIG. 13, the members in the connecting section C2 are given parenthesized numbers. The fitting hole 137 has, on the edge, similar notches 166*a*,166*b* to those in the connecting section C1.

Next, the structure of the control valve 110 will be described referring to FIG. 12. As described above, the control valve 110 is provided with the gas release valve 108 and air inlet valve 109, formed integrally therewith. The gas release valve 108 and the air inlet valve 109 are disposed on the upper side and the lower side of the control valve 110, respectively. A couple of diaphragms 145,146, which are housed in the control valve 110, are made of a flexible material and have a disc-like shape. The diaphragm 145 is disposed in the gas release valve 108 and retained at its periphery between the housing 147 of the control valve 110 and an upper cover 148. The other diaphragm 146 is disposed in the air inlet valve 109 and retained at its periphery between the housing 147 and a lower cover 149.

In the gas release valve 108, the space enclosed between the diaphragm 145 and the upper cover 148 forms an atmospheric pressure chamber 150. An atmospheric port 151 is open to the atmosphere. In the air inlet valve 109, the space enclosed between the diaphragm 146 and the lower cover 149 forms a pressure chamber 152. The pressure chamber 152 is communicated with the first chamber 99 through the pressure passage 107. The space defined between these two diaphragms 145,146 constitutes a pressure chamber 154 common to the valves 109,108. The pressure chamber 154 is communicated with the second chamber 100 through the pressure pipe 135. In the air inlet valve 109, the part of the housing 147 extending downward constitutes an opening 154*a* of the pressure chamber 154. The space surrounded by the housing 47, opening 154*a* and diaphragm 146 constitutes an atmospheric pressure chamber 153. An air inlet valve 157 connected to the atmospheric pressure chamber 153 introduces atmospheric pressure into the atmospheric pressure chamber 153. A valve plate 158 applied to the diaphragm 146 closes the opening 154*a* of the pressure chamber 154.

The housing 147 of the control valve 110 includes an air pipe 155 which extends from the internal portion of the valve 110 toward the outside. The distal end 155*a* of the air pipe 155 opens into the atmosphere. The proximal end 155*b* of the air pipe 155 is closed by a valve plate 156 applied to the diaphragm 145. A spring 161 is interposed between a spring retainer 159 located the center of the diaphragm 145 and a protrusion 160 formed on the inner surface of the upper cover 148. The spring 161 urges the valve plate 156 downward. The urging direction of this spring 161 closes the proximal end 155*b* of the air pipe 155 with the valve plate 156. Accordingly, when the pressure introduced from the second chamber 100 to the pressure chamber 154 is lower than a predetermined level, the diaphragm 145 is not shifted up, and the gas release valve 108 is closed.

In the air inlet valve 109, a spring 164 is likewise disposed between a spring retainer 162 located at the center of the diaphragm 146 and a protrusion 163 formed on the inner surface of the lower cover 149, and the spring 164 urges the valve plate 158 upward. The urging direction of the spring 164 closes the opening 154*a* of the pressure chamber 154 with the valve plate 158. Accordingly, the air inlet valve 109 is closed under the normal condition. When the fuel vapor in the canister 81 is to be purged to the intake passage 95, the relatively low pressure in the purge line 94 from the surge tank 95*a* is transmitted through the pressure passage 107 to the pressure chamber 152. A difference is generated between the pressure in the pressure chamber 152 and the pressure in the atmospheric pressure chamber 153 under the action of this low pressure to open the air inlet valve 109 and allow the outside air to be introduced into the canister 81 through the air inlet pipe 157.

The air inlet valve 109 and the gas release valve 108 yield to different pressure levels. In this embodiment, the pressure level required for opening the gas release valve 108 is smaller than the pressure level for opening the air inlet valve 109. The reason is to increase the capacity of treating the fuel vapor during ORVR treatment by speedily exhausting to the outside of the system the residual gas left after collection of the fuel in the canister 81. When the canister 81 is mounted on a vehicle, the valves 108,109 are oriented such that gravity is exerted on the diaphragms 145,146, spring retainers 159,162 and valve plates 156,158. Gravity is exerted in the direction of closing the gas release valve 108 and opening the air inlet valve 109. The reason why the gas release valve 108 is disposed above the air inlet valve 109 will be described below.

The level of pressure required for opening the gas release valve 108 is smaller than that for opening the air inlet valve 109. If the gas release valve 108 were inverted from the position of FIG. 12, the level of pressure required for opening the gas release valve 108 would be smaller due to the force of gravity on the plate 156. Consequently, the gas release valve 108 would not hold a stable closed position. That is, the gas release valve 108 may be opened by vibration of the automobile. While a spring 161 having a greater spring constant may be used to avoid this, the increased spring constant reduces the distance that the valve plate 156 separates from the air pipe 155 when the gas release valve 108 is let open. Accordingly, the amount of gas exhausted to the atmosphere through the gas release valve 108 will be small. Thus, in this embodiment, the gas release valve 108 is oriented such that the force of gravity closes the valve 108 so as to ensure that a large amount of gas is exhausted to the atmosphere through the gas release valve 108.

As shown in FIG. 12, the axis of the valve 108 is offset by a predetermined value S relative to the axis of the valve 109.

Next, the operation of the canister 81 will be described. First, the situation where the fuel vapor in the tank 82 is introduced to the canister 81 in the steady state treatment will be described referring to FIGS. 8 and 11. When the fuel evaporates in the tank 82, the amount of the fuel vapor in the tank 82 increases to elevate the internal pressure of the tank 82. Then, the fuel vapor in the tank 82 is introduced through the vapor line 83 and evaporation pipe 130 to the positive pressure chamber 128 of the first control valve 84. The fuel vapor in the positive pressure chamber 128 pushes up the diaphragm 124 against the pressure of the atmospheric pressure chamber 127 and the urging force of the spring 134. If the difference between the pressure introduced to the positive pressure chamber 128 from the tank 82 and the pressure in the atmospheric pressure chamber 127 exceeds a predetermined level, the first control valve 84 is opened. Subsequently, the fuel vapor passes through the pressure pipe 122 and the guide passage 121 to the pressure pipe 111, and is further fed through the vapor port 115 to the canister 81. In this process, the same level of pressure as in the tank 82 is exerted to the first pressure chamber 88 of the differential pressure regulating valve 86, so that the valve 86 does not open the breather line 92.

Next, the situation where the fuel vapor in the tank 82 is introduced to the canister 81 in ORVR treatment will be described referring to FIGS. 8 and 11. A cap 167 is removed from the pipe 89 so that a fuel feeding nozzle can be inserted to the inlet pipe 89 for refueling. As a result, the internal pressure of the inlet pipe 89 becomes equal to the atmospheric pressure. The first pressure chamber 88 of the differential pressure regulating valve 86 communicates with the inlet pipe 89 via the pressure passage 90, so that the pressure in the pressure chamber 88 becomes equal to the atmospheric pressure. Then, when fuel is charged into the tank 82, the liquid surface in the tank 82 rises, and the tank 82 is filled with fuel vapor. Accordingly, the internal pressure of the tank 82 is increased, and the increased pressure is introduced to the breather pipe 85. When the difference between the pressure in the breather pipe 85 and in the first pressure chamber 88 (atmospheric) reaches a predetermined level, the diaphragm 87 of the valve 86 is pushed up by the pressure in the breather pipe 85 to open the valve 86. Consequently, the fuel vapor in the tank 82 can be introduced to the canister 81 through the breather line 92. Since the pressure required for opening the differential pressure regulating valve 86 is set to a level smaller than the pressure required for opening the first control valve 84, the control valve 84 remains closed.

Therefore, the fuel vapor in the tank 82 is introduced to the canister 81 through the vapor line 83 or the breather line 92 in the steady state treatment or ORVR treatment, respectively.

Next, the situation where the fuel vapor introduced into the canister 81 is will be described treated referring to FIGS. 9, 11 and 12. The fuel vapor introduced into the canister 81 passes through the air layer 101 and the filter 103, and then is introduced to the adsorbent layer 102 in the first chamber 99. Here, the fuel component of the fuel vapor is adsorbed on the adsorbent 105 in the adsorbent layer 102. Subsequently, the fuel vapor passes through the filter 104 and is introduced to the diffusion chamber 106, where it flows toward the second chamber 100. Further, the fuel vapor passes through the filter 104 and is introduced to the adsorbent layer 102 in the second chamber 100, where the fuel component of the fuel vapor is further adsorbed on the adsorbent 105.

The residual gas left after a substantial portion of the fuel is adsorbed passes through the filter 103, the air layer 101 and the atmospheric port 139 and is then introduced to the pressure chamber 154 of the second control valve 110. When the amount of fuel vapor introduced to the canister 81 through the vapor line 83 and the breather line 92 is small, or when the internal pressure of the canister 81 is low, both the gas release valve 108 and the air inlet valve 109 are closed. Accordingly, the gas introduced to the pressure chamber 154 is not exhausted into the atmosphere. When the amount of the fuel vapor introduced to the canister 81 is increased and the internal pressure of the canister 81 exceeds a predetermined level, the diaphragm 145 of the gas release valve 108 is shifted up by the pressure in the pressure chamber 154 to open the gas release valve 108. Accordingly, the gas introduced to the pressure chamber 154 is exhausted to the outside through the gas release valve 108 and the air pipe 155. Since the gas release valve 108 is a diaphragm check valve, it allows passage of a large amount of gas therethrough unlike the conventional ball check valve. That is, compared with a canister employing a ball check valve as the gas release valve 108, the air-flow resistance in this embodiment is very small. Thus, the canister 81 can treat a large amount of fuel vapor in ORVR treatment. The gas release valve 108 is superior to the ball check valve also in its response to the pressure change in the canister 81.

While the gas release valve 108 is opened whenever the internal pressure of the canister 81 exceeds a predetermined level, the air inlet valve 109 remains closed. The pressure in the first chamber 99 is communicated with the pressure chamber 152 of the air inlet valve 109 so that the diaphragm 146 is pushed upward (in FIG. 12). On the other hand, the diaphragm 146 is subject to the pressure in the pressure chamber 154 and also to the pressure in the atmospheric pressure chamber 153 so that it is pushed downward (in FIG. 12). In this state, the pressure in the pressure chamber 154 is equal to that in the pressure chamber 152, and the atmospheric pressure is introduced to the atmospheric pressure chamber 153 through the air inlet pipe 157.

Accordingly, the valve plate 158 is pushed in the direction of closing the opening 154*a* so the gas in the pressure chamber 154 is prevented from leaking out through the air inlet pipe 157.

As described above, in this embodiment, the fuel component of the fuel vapor is adsorbed on the adsorbent layer 102 while the fuel vapor passes through the two chambers 99,100 in the canister 81. Since the route that the fuel vapor flows in the canister 81 is substantially U-shaped, it is relatively long. Thus the time during which the fuel vapor contacts the adsorbent 105 is extended. Consequently, the fuel component contained of the fuel vapor can efficiently be collected.

Meanwhile, when the tank 82 is cooled after parking for a long time and formation of fuel vapor in the tank 82 stops, the internal pressure of the canister 81 is lowered. If the relief valve 123 is let open in such state, the gas in the canister 81 is returned to the tank 82 through the pressure pipe 111, guide passage 121, relief valve 123, evaporation pipe 130 and vapor line 83.

Next, the situation where the fuel component collected in the canister 81 is purged to the intake passage 95 will be described referring to FIGS. 8 and 12. When the engine 171 is started, air for combustion flows through the intake passage 95. With the flow of this air, a negative pressure acts against the purge line 94 communicating to the surge tank 95*a*. A flow of fuel vapor from the canister 81 toward the surge tank 95*a* is created by opening the purge control valve 96 based on a control signal from an ECU 97. Thus, the pressure in the canister 81 is converted to a negative level, and the negative pressure is transmitted through the pressure passage 107 to the pressure chamber 152 of the air inlet valve 109. Thus, the pressure chamber 152 has an internal pressure below a predetermined level. Consequently, the diaphragm 146 is shifted down by the negative pressure of the pressure chamber 152 to open the air inlet valve 109, and outside air is introduced into the atmospheric pressure chamber 153. The outside air is then fed through the opening 154*a* to the pressure chamber 154, and then to the second chamber 100 through the pressure pipe 135 and atmospheric port 139. Thus, the fuel component adsorbed on the adsorbent 105 is released to be absorbed in this outside air. The outside air absorbing the fuel passes through the second chamber 100, diffusion chamber 106 and first chamber 99. Then, it is guided to the purge line 94 and is purged to the surge tank 95*a* through the purge control valve 96.

The fuel purged into the surge tank 95*a* is mixed with the outside air introduced through the air cleaner 172 provided at the inlet of the intake passage 95, and the resulting gas is fed to the respective cylinders of the engine 171. The fuel vapor thus mixed with the outside air is pumped to injectors 169 by a pump 168 disposed in the tank 82 and fed to the cylinders together with the fuel injected from the injectors 169. It should be noted here that a large amount of outside air can be introduced through the opening 154*a* to the canister 81, because the air inlet valve 109 is a diaphragm check valve. Thus, the amount of fuel absorbed is increased. When the adsorbent 105 has adsorbed some amount of fuel, its effectiveness is reduced. However, the adsorption effectiveness can be improved if the fuel is released from the adsorbent 105 by the outside air introduced to the canister 81. Accordingly, the performance of adsorption of the adsorbent 105 is constantly maintained at a high level by introducing a large amount of outside air. Thus, the efficiency of collecting the fuel is improved.

As described, the canister 81, according to this embodiment, can treat a large amount of fuel vapor in ORVR treatment. Further, when the fuel vapor in the canister 81 is to be purged to the intake passage 95, a large amount of outside air can be introduced to the canister 81 so as to speedily release a large amount of fuel from the adsorbent 105, and thus the capacity of collecting the fuel vapor by the canister 81 is improved.

The canister 81 of this embodiment has the following characteristics: The second control valve 110 provided on the casing 81*a* includes the gas release valve 108 and the air inlet valve 109. Accordingly, unlike the case where these two valves are attached separately to the casing 81*a*, only one opening (atmospheric port 139) in which the second control valve 110 is to be fitted needs to be formed on the casing 81*a*, reducing the number of sites to be sealed. Further, since these valves 108 and 109 are integrated into a single body, the number of parts is reduced.

In this embodiment, the first control valve 84 and the second control valve 110 are designed to be detachable from the casing 81*a*. Accordingly, by employing the same structure for the connecting sections C1 and C2 and also employing the same fitting technique, these control valves 84,110 can be applied to other casings 81*a* of different specifications. Thus, the same parts can be commonly utilized. Likewise, even in cases where these control valves 84,110 are of different specifications, the casing 81*a* can be commonly utilized. By providing common parts, the cost of producing the canister 81 is reduced.

Since the valves 108,109 are designed to be detachable from the casing 81*a* in this embodiment, the maintenance of the valves 108,109 is facilitated. These two valves 108,109 can easily be attached to the casing 81*a*. Thus, the procedure of fitting these valves 108,109 is simplified. Further, parts such as hoses and clamps can be omitted.

Since the pressure chamber 154 is designed to be common to the valve 108 and valve 109 in this embodiment, the second control valve 110 can be made smaller. In addition, since the center of the valve 108 is offset from that of the valve 109, the height (vertical length in FIG. 12) of the control valve 110 can be reduced. This also allows the control valve 110 to be made smaller. Since the control valve 110 is downsized, when it is attached to the casing 81*a*, it can be included within the total width L and the total height H of the canister 81. Thus, the canister 81 can be downsized as a whole, and the flexibility in mounting the canister 81 onto automobiles can be improved.

Further, in this embodiment, the pressure required for opening the air inlet valve 109, housed in the second control valve 110, must be greater than the pressure required for opening the gas release valve 108, also housed therein. Accordingly, the air inlet valve 109 is normally maintained to be closed in spite of the force of gravity. This improves the reliability of the second control valve 110.

Although only three embodiments of the present invention have been described herein, it should be apparent to those skilled in the art that the present invention may be embodied in many other specific forms without departing from the spirit or scope of the invention. Particularly, it should be understood that the present invention may be embodied in the following manners:

In the first embodiment, the restrictor 57 is formed in the pressure passage 56 connecting the purge line 31 to the first control valve 50. However, the purge line 31 may be connected to the second control valve 70 via a pressure passage, and the restrictor may be disposed in this pressure passage. In this case, fluctuation of pressure can also be transmitted to the pressure chamber of the diaphragm check valve, and the pressure fluctuation can be controlled by the restrictor so as to achieve smooth opening and closing of the second control valve 70.

In the first embodiment, the inner space of the canister 30 is divided into three chambers; the main chamber 34, the first sub-chamber 35*a* and the second sub-chamber 35*b*. However, the inner space of the canister may be divided into two chambers. The number of chambers in the canister can be chosen depending on the desired capacity for adsorbing the fuel vapor.

While the restrictor 57 is formed in the second pressure port 55 in the second embodiment, it may be formed in the first pressure port 47. The restrictor 57 can be disposed anywhere in the pressure passage 56.

In the third embodiment, the pressure pipes 111,135 are connected to the first and second control valves 84,110, respectively, while fitting holes 113,137 for inserting these pipes 111,135, respectively, are formed on the casing 81*a*. However, pressure pipes may be disposed on the casing, and fitting holes may be formed on the control valves 84,110.

While the pressure pipes 111,135 of the first and second control valves 84,110 are provided with protrusions 116*a*, 116*b*,140*a*,140*b*, in the third embodiment, the number of protrusions to be formed on each pipe may be three or more.

In the third embodiment, the breather line 92 for ORVR treatment is provided between the tank 82 and the canister 81, in addition to the vapor line 83 for steady state treatment. However, the breather line 92 may be omitted so as to carry out steady state vapor treatment only.

While the canister 81 described in the third embodiment is of side flow type, in which the fuel vapor flows in the horizontal direction, the present invention may be embodied in an up-down flow type canister.

Therefore, the present examples and embodiments are to be considered as illustrative and not restrictive, and the invention is not to be limited to the details given herein, but may be modified within the scope of appended claims.

What is claimed is:

1. An apparatus for treating fuel vapor evaporated in a fuel tank, having a canister for collecting the fuel component and allowing a passage of gas, both the fuel component and the gas contained in the fuel vapor which is introduced to the canister through a vapor line, and an air intake passage communicating an engine, said canister having an inlet port for introducing air thereinto based on negative pressure generated in the canister and an outlet port for releasing the gas therefrom based on positive pressure generated in the canister, wherein said fuel vapor is purged to the air intake passage from the canister through a purge line when the engine is in the operation, and wherein the amount of fuel vapor passing through the purge line is controlled by a purge control valve actuated by a duty signal from a controller in accordance with information representing engine operation status, said apparatus comprising:

a first valve means provided with the canister, for selectively opening and closing the inlet port, wherein said first valve means opens the inlet port based on said negative pressure in the canister by the fuel vapor purged to the air intake passage from the canister;

a second valve means provided with the canister, for selectively opening and closing the outlet port, wherein said second valve means opens the outlet port based on said positive pressure in the canister by the fuel vapor introduced to the canister from the fuel tank;

at least one of said first and second valve means including a diaphragm check valve, said diaphragm check valve having a pressure chamber;

a pressure passage connecting the pressure chamber with the canister to introduce the negative pressure to the pressure chamber from the canister; and an orifice formed in the pressure passage to dampen the pressure changes downstream thereof with respect to the purge line.

2. The apparatus as set forth in claim 1, wherein said orifice includes a hole for reducing an inner diameter of the pressure passage.

3. An apparatus for treating fuel vapor evaporated in a fuel tank, having a canister for collecting the fuel component and allowing a passage of gas, both contained in the fuel vapor supplied to the canister through a vapor line, and an air intake passage communicating an engine, said canister having an inlet port for introducing gas thereinto based on negative pressure generated in the canister and an outlet port for releasing the gas therefrom based on positive pressure generated in the canister, wherein said fuel vapor is purged to the air intake passage from through a purge line when the engine is in the operation, said apparatus comprising:

a first diaphragm check valve provided with the canister, for selectively opening and closing the inlet port, wherein said first diaphragm check valve opens the inlet port based on said negative pressure in the canister by the fuel vapor purged to the air intake passage from the canister, said first diaphragm check valve having a first pressure chamber;

a pressure passage connecting the first pressure chamber with the canister to introduce the negative pressure to the first pressure chamber from the canister;

a second diaphragm check valve provided with the canister, for selectively opening and closing the outlet port, wherein said second diaphragm check valve opens the outlet port based on said positive pressure in the canister by the fuel vapor introduced to the canister from the fuel tank, said second diaphragm check valve having a second pressure chamber for receiving said positive pressure from the canister; and a single housing for accommodating said diaphragm check valves, said housing mounted on the canister.

4. The apparatus as set forth in claim 3, wherein said canister has an adsorbent for adsorbing the fuel vapor.

5. The apparatus as set forth in claim 4 further comprising a breather line connecting the fuel tank and the canister to allow a passage of the fuel vapor evaporated when the fuel is supplied to the fuel tank, said breather line having an inner diameter larger than an inner diameter of the vapor line.

6. The apparatus as set forth in claim 5 further comprising a control valve for generally closing the breather line, said control valve being arranged to open the breather line when the fuel is supplied to the fuel tank.

7. The apparatus as set forth in claim 3, wherein said pressure in absolute value required to open the second diaphragm check valve is greater than said pressure in absolute value required to open the first diaphragm check valve.

8. The apparatus as set forth in claim 7, wherein said outlet port is directed vertically and wherein said second diaphragm check valve has a diaphragm having a substantially plane portion extending perpendicular to the vertical direction.

9. The apparatus as set forth in claim 3, wherein said diaphragm check valves respectively have a diaphragm eccentrically opposing to each other.

10. The apparatus as set forth in claim 3, wherein said housing is detachably mounted on the canister.

* * * * *